US010013837B2

(12) United States Patent
Takada et al.

(10) Patent No.: US 10,013,837 B2
(45) Date of Patent: Jul. 3, 2018

(54) MEDIUM PROCESSING DEVICE AND MEDIUM TRANSACTION DEVICE

(71) Applicant: Oki Electric Industry Co., Ltd., Tokyo (JP)

(72) Inventors: Atsushi Takada, Tokyo (JP); Masaki Takada, Tokyo (JP); Hiroshi Yokokawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/525,453

(22) PCT Filed: Oct. 9, 2015

(86) PCT No.: PCT/JP2015/078842
§ 371 (c)(1),
(2) Date: May 9, 2017

(87) PCT Pub. No.: WO2016/076048
PCT Pub. Date: May 19, 2016

(65) Prior Publication Data

US 2017/0323509 A1 Nov. 9, 2017

(30) Foreign Application Priority Data

Nov. 14, 2014 (JP) ..... 2014-231736

(51) Int. Cl.
*G07F 7/04* (2006.01)
*G07D 11/00* (2006.01)
*B65H 29/00* (2006.01)

(52) U.S. Cl.
CPC ..... *G07D 11/0012* (2013.01); *B65H 29/006* (2013.01); *G07D 11/0006* (2013.01); *G07F 7/04* (2013.01); *B65H 2301/41912* (2013.01)

(58) Field of Classification Search
CPC ..... B65H 16/00; B65H 16/005; B65H 16/10; B65H 23/005; B65H 23/18;
(Continued)

(56) References Cited

U.S. PATENT DOCUMENTS 6,520,446 B2 * 2/2003 Eugster ..... B65H 26/00 242/528
2011/0073611 A1 * 3/2011 Tosaka ..... B65H 29/006 221/71
(Continued)

FOREIGN PATENT DOCUMENTS

JP S50-014146 Y1 5/1975
JP S55-089938 A 7/1980
(Continued)

*Primary Examiner* — Mark J Beauchaine
(74) *Attorney, Agent, or Firm* — Rabin & Berdo, P.C.

(57) ABSTRACT

A medium processing device includes: a drum that has a circular cylinder shape and that rotates about a rotation shaft; a tape that, together with a medium, is wrapped onto a drum circumferential face, this being a circumferential face of the drum; a reel onto which the tape is pre-wound, and from which the tape is pulled out accompanying rotation of the drum; and a rotation restriction mechanism. The rotation restriction mechanism includes a restriction section that is obstructed from moving by the tape wrapped onto the drum circumferential face, and that moves when the drum rotates in an unwind direction to unwind the tape such that the tape comes away from the drum circumferential face to expose a wrapping location of the tape onto the drum circumferential face, and a stopper section that abuts the restriction section so as to restrict rotation of the drum in the unwind direction.

14 Claims, 20 Drawing Sheets

(58) Field of Classification Search
CPC ..... B65H 2301/4152; B65H 2403/70; G07D 11/0003; G07D 11/0006; G07D 11/0021; G07D 11/0045; G07D 2211/00
See application file for complete search history.

(56) References Cited

U.S. PATENT DOCUMENTS

| | | | | |
|---|---|---|---|---|
| 2012/0313493 | A1* | 12/2012 | Yokote ..... | G07D 11/0006 312/186 |
| 2015/0014469 | A1 | 1/2015 | Iwatsuki | |

FOREIGN PATENT DOCUMENTS

| | | | |
|---|---|---|---|
| JP | S59-082267 | A | 5/1984 |
| JP | S63-071677 | U | 5/1988 |
| JP | S63-127967 | A | 5/1988 |
| JP | H02-002155 | U | 1/1990 |
| JP | 2013-196431 | A | 9/2013 |
| JP | 2014-002720 | A | 1/2014 |
| WO | WO-2009/157264 | A1 | 12/2009 |

* cited by examiner

MEDIUM PROCESSING DEVICE AND MEDIUM TRANSACTION DEVICE

TECHNICAL FIELD

This application claims priority from Japanese Patent Application No. 2014-231736, filed on Nov. 14, 2014, the disclosure of which is incorporated in its entirety by reference herein.

The present disclosure relates to a medium processing device and a medium transaction device, and is adapted for application to, for example, an Automatic Teller Machine (ATM) that is input with a medium such as banknotes and that carries out desired transactions.

BACKGROUND ART

Hitherto, ATMs and the like employed in financial institutions and shops, for example, receive cash such as banknotes and coins paid in by a customer, or pay out cash to the customer, based on the content of a transaction with the customer. ATMs exist that include, for example, a banknote pay-in/pay-out section that exchanges banknotes with a customer, a classification section that classifies inserted banknotes by denomination and authenticity and reads serial numbers, a temporary retention section that temporarily retains inserted banknotes, a conveyance section that conveys banknotes, and banknote storage boxes that store banknotes by denomination.

Proposals have been made for temporary retention sections including, for example, a circular cylinder shaped rotating drum and a long tape, with one end of the tape being fixed to a circumferential face of the drum such that the tape and banknotes are wrapped onto the drum in layers, thereby storing the banknotes (see, for example, Japanese Patent Application Laid-Open (JP-A) No. 2013-196431).

SUMMARY OF INVENTION

Technical Problem

As illustrated in FIG. 30 and FIG. 31, in a temporary retention section 1020, a drum 34 is rotated in an unwind direction R2 to discharge banknotes BL that have been stored against a circumferential face of the drum 34 to the exterior. Note that if the drum 34 rotates further in the unwind direction R2 after a tape start end portion 1038*s* where a tape 1038 is fixed to the drum 34 has been exposed, as illustrated in FIG. 32, the tape 1038 is wound onto the drum 34 in the opposite direction to the original direction as illustrated in FIG. 33 and FIG. 34, and reverse-winding occurs. If, in an attempt to wrap banknotes BL onto the circumferential face of the drum 34, the drum 34 were to be rotated in the opposite direction to the unwind direction R2 from a state in which reverse-winding has occurred, tape jams may result, such that reliability cannot be maintained.

In consideration of the above circumstances, the present disclosure proposes a medium processing device and medium transaction device capable of increasing reliability.

Solution to Problem

A first aspect of the present disclosure is a medium processing device including: a drum that is configured in a circular cylinder shape and that rotates about a rotation shaft; a tape that, together with a medium to be stored, is wrapped onto a drum circumferential face, this being a circumferential face of the drum; and a reel onto which the tape is pre-wound, and from which the tape is pulled out accompanying rotation of the drum. The medium processing device further includes a rotation restriction mechanism including a restriction section that is obstructed from moving by the tape wrapped onto the drum circumferential face, and that moves when the drum rotates in an unwind direction to unwind the tape such that the tape comes away from the drum circumferential face to expose a wrapping location of the tape onto the drum circumferential face, and a stopper section that abuts the restriction section so as to restrict rotation of the drum in the unwind direction.

A second aspect of the present disclosure is a medium transaction device including: a customer interface section that receives a transaction relating to a medium; a drum that is configured in a circular cylinder shape and that rotates about a rotation shaft; a tape that, together with a medium to be stored, is wrapped onto a drum circumferential face, this being a circumferential face of the drum; and a reel onto which the tape is pre-wound, and from which the tape is pulled out accompanying rotation of the drum. The medium transaction device further includes a rotation restriction mechanism including a restriction section that is obstructed from moving by the tape wrapped onto the drum circumferential face, and that moves when the drum rotates in an unwind direction to unwind the tape such that the tape comes away from the drum circumferential face to expose a wrapping location of the tape onto the drum circumferential face, and a stopper section that abuts the restriction section so as to restrict rotation of the drum in the unwind direction.

These aspects enabling reverse-winding of the drum to be prevented when the tape has been unwound as far as a tape fixing portion where the tape is fixed to the drum.

Effects of Invention

These aspects enable reverse-winding of the drum to be prevented when the tape has been unwound as far as a tape fixing portion where the tape is fixed to the drum, and thereby enable a medium processing device and a medium transaction device capable of increasing reliability to be realized.

DESCRIPTION OF EMBODIMENTS

Explanation follows regarding embodiments (referred to below as exemplary embodiments) for implementing the present disclosure, with reference to the drawings.

1. First Exemplary Embodiment

1-1. Configuration of ATM

Figure 1:
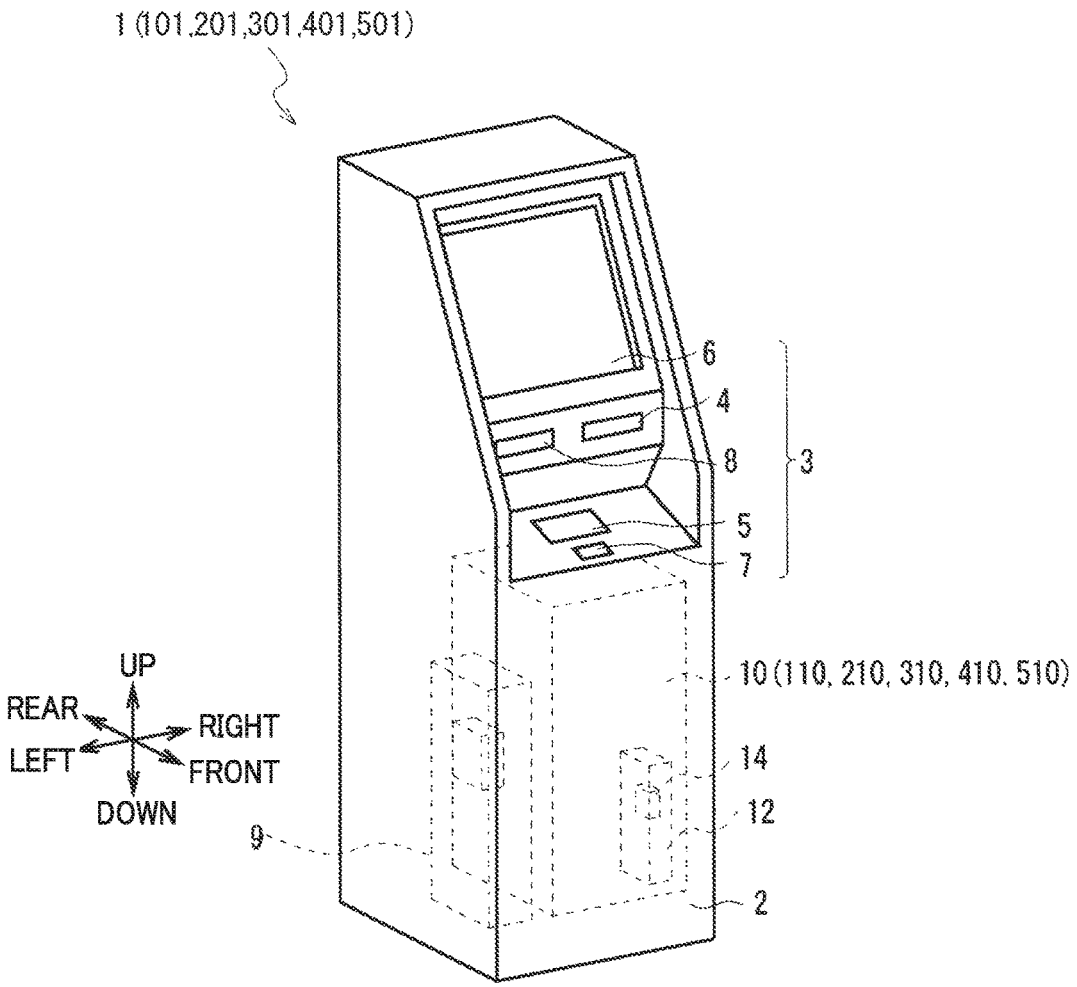
FIG. 1 is a perspective view illustrating configuration of an ATM.

As illustrated in external view in FIG. 1, an ATM 1 is configured mainly by a box shaped casing 2, and is, for example, installed in a financial institution or the like to perform cash transactions such as pay-in transactions and pay-out transactions with a customer. The casing 2 is provided with a customer interface section 3 at a location enabling easy banknote insertion, touch panel operation, and so on by a customer in a state facing the front side of the casing 2.

The customer interface section 3 includes a card insertion/removal port 4, a pay-in/pay-out port 5, an operation and display section 6, a ten-key 7, and a receipt issue port 8. Cash, passbooks, and the like are passed between the customer interface section 3 and the customer directly, and the customer interface section 3 notifies transaction information and receives operation instructions. The card insertion/removal port 4 is a section for insertion and return of various cards, such as cash cards. A card processor (not illustrated in the drawings) that reads account numbers and the like magnetically recorded on the various cards is provided behind the card insertion/removal port 4. The pay-in/pay-out port 5 is a section that is input with banknotes being paid in by a customer, and that dispenses banknotes being paid out to a customer. The pay-in/pay-out port 5 is opened up and closed off by driving a shutter. The operation and display section 6 is integrated with a Liquid Crystal Display (LCD) that displays operation screens during a transaction, and a touch panel for inputting transaction type selections, PINs, transaction amounts, and the like. The ten-key 7 is a physical keypad that receives input of, for example, the numbers 0 to 9. The ten-key 7 is employed during PIN and transaction amount input operations and the like. The receipt issue port 8 is a section that issues receipts printed with transaction details and the like at the end of transaction processing. A receipt processor (not illustrated in the drawings) that prints the transaction details and the like on the receipt is provided behind the receipt issue port 8.

A main controller 9 that performs overall control of the entire ATM 1, a banknote pay-in/pay-out device 10 that performs various processing related to banknotes, and the like are provided inside the casing 2. The main controller 9 is configured mainly by a Central Processing Unit (CPU), not illustrated in the drawings, and reads and executes predetermined programs from a storage section configured by read only memory (ROM), random access memory (RAM), a hard disk drive, flash memory, or the like, in order to control the respective sections so as to perform various processing in pay-in transactions, pay-out transactions, and the like.

In the following explanation, the side of the ATM 1 faced by a user is defined as the front side, and the opposite side thereto is defined as the rear side. The left side and the right side left are respectively defined by the left and right from the perspective of a user facing the front side, and the upper side and lower side are also defined from the perspective of a user facing the front side.

1-2. Internal Configuration of the Banknote Pay-in/Pay-Out Device

Figure 2:
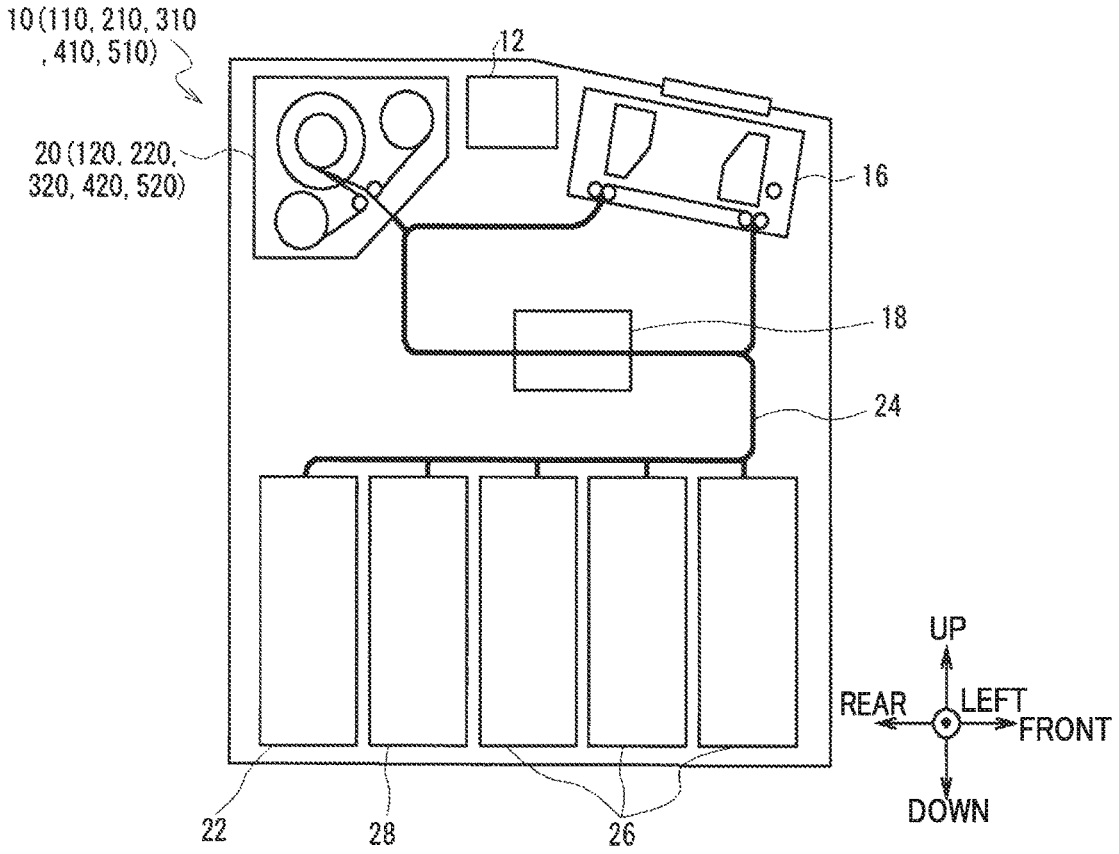
FIG. 2 is a side view from the left illustrating configuration of a banknote pay-in/pay-out device.

As illustrated in FIG. 2, a banknote controller 12 performs overall control of respective sections of the banknote pay-in/pay-out device 10 (including a banknote pay-in/pay-out section 16, a conveyance section 24, a classification section 18, a temporary retention section 20, banknote storage boxes 26, a reject box 28, and a forgotten banknote box 22).

The banknote controller 12 is configured mainly by a CPU, not illustrated in the drawings, and reads and executes predetermined programs from a storage section 14 (FIG. 1) configured from ROM, RAM, a hard disk drive, flash memory, or the like in order to control the respective sections and perform various processing in pay-in transactions, pay-out transactions, and the like. The storage section 14 stores classification results, banknote serial number identification results, and the like from banknote classification by the classification section 18 together with transaction information.

The banknote pay-in/pay-out section 16, the classification section 18 that determines the denomination and authenticity of banknotes, and the temporary retention section 20 that temporarily stores pay-in banknotes and the like are provided at an upper side inside the banknote pay-in/pay-out device 10.

The banknote pay-in/pay-out section 16 separates and feeds out banknotes inserted by a customer to the conveyance section 24 one note at a time. Banknotes to be fed out to the conveyance section 24 and banknotes returned to the banknote pay-in/pay-out section 16 as pay-in unacceptable banknotes are kept separately to each other in the banknote pay-in/pay-out section 16. The banknote pay-in/pay-out section 16 includes banknote detection sensors, not illustrated in the drawings, to detect whether or not banknotes to be fed out to the conveyance section 24 are present, provided inside the banknote pay-in/pay-out section 16.

The conveyance section 24 uses rollers, belts, and the like, not illustrated in the drawings, to convey rectangular shaped banknotes along conveyance paths, indicated by bold lines in the drawings, with the short edges of the banknotes in the conveyance direction. The conveyance section 24 conveys banknotes through the classification section 18 in a front-rear direction, and connects a rear side of the classification section 18 to the temporary retention section 20 and the banknote pay-in/pay-out section 16 respectively. The conveyance section 24 also connects a front side of the classification section 18 to the banknote pay-in/pay-out section 16, the banknote storage boxes 26, the reject box 28, and the forgotten banknote box 22. Junctions on the conveyance section 24 are provided with selectors (not illustrated in the drawings) that pivot under the control of the banknote controller 12 in order to switch the banknote conveyance destinations. The conveyance section 24 is provided with banknote detecting sensors at plural locations to detect banknotes, and sends banknote detection results to the banknote controller 12.

The classification section 18 uses optical elements, magnetic detection elements, or the like to classify banknotes by denomination, authenticity, degree of damage (condition), and the like as the banknotes are conveyed through the inside of the classification section 18. The classification section 18 notifies the banknote controller 12 of the classification results. Using captured banknote image data, the classification section 18 also reads and identifies a serial number that is pre-printed on one face of each banknote in roman letters, numbers, and the like to configure banknote identification information issued for each banknote. When this is performed, the classification section 18 notifies the banknote controller 12 of the identified characters as an identification result. In response the banknote controller 12 determines a conveyance destination for the banknote based on the acquired classification results and identification result.

The temporary retention section 20 temporarily retains banknotes inserted into the banknote pay-in/pay-out section 16 by a customer during pay-in. The temporary retention section 20 temporarily retains pay-in acceptable banknotes that the classification section 18 has classified as being acceptable for pay-in until pay-in has been finalized. On the other hand, pay-in unacceptable banknotes classified as being unacceptable for pay-in are discharged into the banknote pay-in/pay-out section 16. During pay-out, the temporary retention section 20 also temporarily retains pay-out unacceptable banknotes that the classification section 18 has classified as being unacceptable for pay-out until pay-out acceptable banknotes have been paid out. The pay-out unacceptable banknotes are then discharged into the reject box 28.

At a lower side inside the banknote pay-in/pay-out device 10, the banknote pay-in/pay-out device 10 is provided with the banknote storage boxes 26 that store banknotes by denomination, the reject box 28 that stores banknotes classified as damaged banknotes (referred to as damaged notes) by the classification section 18, banknotes determined to be counterfeit notes, and banknotes in denominations that are not put back into circulation, such as 5000 yen notes and 2000 yen notes, and the forgotten banknote box 22 that recovers and stores banknotes left behind in the banknote pay-in/pay-out section 16 by a customer during a transaction. The banknote storage boxes 26, the reject box 28, and the forgotten banknote box 22 are configured capable of being mounted to and removed from slots provided in the banknote pay-in/pay-out device 10. The banknote storage boxes 26 each use a storage/feed-out mechanism to take in and store banknotes conveyed by the conveyance section 24, and to discharge stored banknotes to be fed to the conveyance section 24.

In the ATM 1 configured in this manner, the main controller 9 and the banknote controller 12 control the respective sections based on the classification results, identification results, and so on of the banknotes by the classification section 18 so as to perform banknote pay-in processing and pay-out processing.

Namely, in a pay-in transaction using the ATM 1, when a pay-in transaction is selected by a customer using the display section 6 and banknotes are inserted into the banknote pay-in/pay-out section 16, the inserted banknotes are conveyed from the banknote pay-in/pay-out section 16 to the classification section 18 one note at a time. The ATM 1 conveys pay-in acceptable banknotes, determined to be acceptable for pay-in based on the classification results and identification results of the classification section 18, to the temporary retention section 20 to be temporarily stored. On the other hand, the ATM 1 returns any pay-in reject banknotes, determined to be unacceptable for pay-in, to the banknote pay-in/pay-out section 16, and opens the shutter to return the pay-in reject banknotes to the customer. After the customer confirms the pay-in amount, and the ATM 1 conveys the banknotes stored in the temporary retention section 20 to the classification section 18 obtain classification results and serial number identification results. In the ATM 1, banknotes determined to be acceptable for storage based on the classification results and identification results of the classification section 18 are conveyed to the respective banknote storage boxes 26 for safekeeping by denomination. On the other hand, the ATM 1 conveys banknotes determined to be unacceptable for storage to the reject box 28.

In a pay-out transaction, when a customer has selected a pay-out transaction and input a pay-out amount using the display section 6, the ATM 1 ascertains the number of notes of each denomination necessary to make up the requested amount, feeds out banknotes from the respective banknote storage boxes 26 according to the number of notes of each denomination, and conveys the banknotes to the classification section 18 to acquire classification results and serial number identification results. Here, the ATM 1 conveys pay-out acceptable banknotes, determined to be acceptable for pay-out based on the classification results and identification results of the classification section 18, to the banknote pay-in/pay-out section 16. On the other hand, the ATM 1 conveys pay-out reject banknotes, determined to be unacceptable for pay-out, to the temporary retention section 20 to be temporarily stored. After banknotes making up the requested amount have been accumulated in the banknote pay-in/pay-out section 16, the ATM 1 opens the shutter. The banknotes accumulated inside the banknote pay-in/pay-out section 16 are thereby placed in a state in which they may be taken, and the customer takes out the banknotes. The ATM 1 then conveys the pay-out reject banknotes stored in the temporary retention section 20 to the reject box 28 for safekeeping.

1-3. Configuration of Temporary Retention Section

Figure 3:
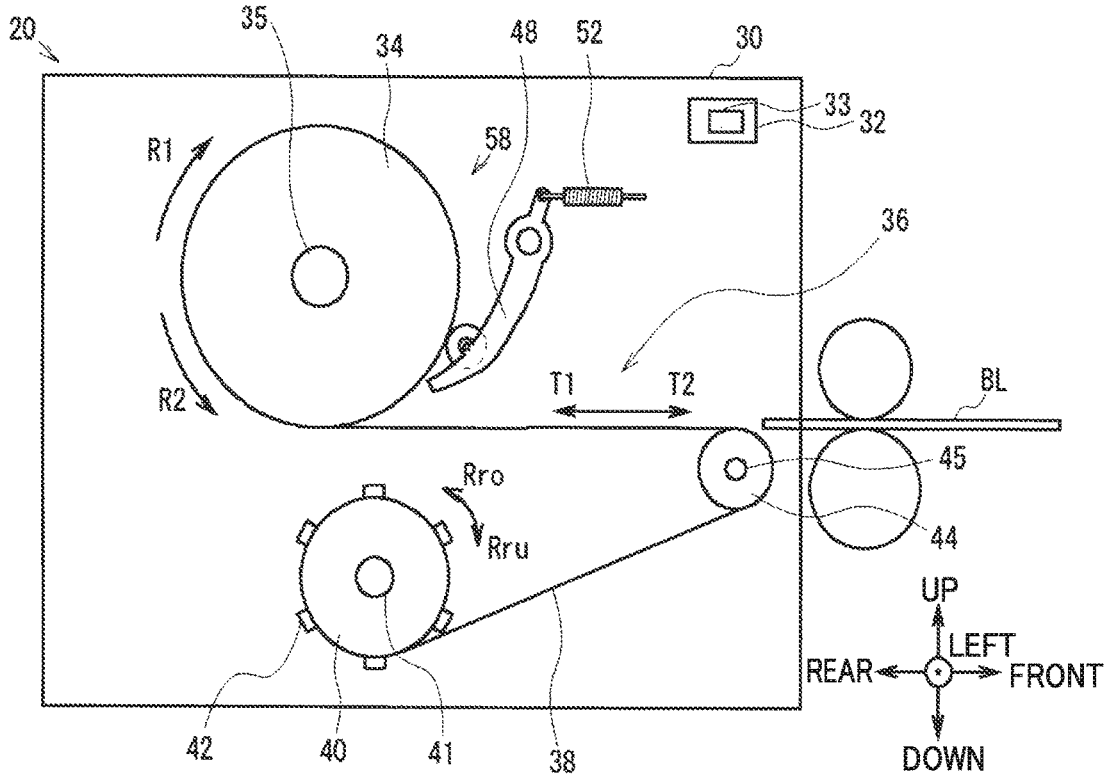
FIG. 3 is a side view from the left illustrating configuration of a temporary retention section according to a first exemplary embodiment.

As illustrated in FIG. 3, the temporary retention section 20 is configured such that respective components are attached to a frame 30. FIG. 3 is a schematic side view from the left of the temporary retention section 20, and some components, such as a motor and gears, are omitted for ease of explanation.

The overall temporary retention section 20 is controlled by a retention controller 32. Similarly to the main controller 9 and the banknote controller 12 (FIG. 1), the retention controller 32 is configured mainly by a CPU, not illustrated in the drawings, and reads and executes a predetermined program from a retention storage section 33 configured by ROM, flash memory, or the like to perform various control in coordination with the banknote controller 12 and the like to rotate a drum, drive a tape, and the like.

A circular cylinder shaped drum 34 is provided in the vicinity of the center of the frame 30 of the temporary retention section 20. The drum 34 is attached so as to be capable of being rotated in a take-up direction R1 and an unwind direction R2 by a motor, not illustrated in the drawings, about a rotation shaft 35 running in the left-right direction. Drive force is transmitted from the motor, not illustrated in the drawings, under the control of the retention controller 32.

Figure 14:
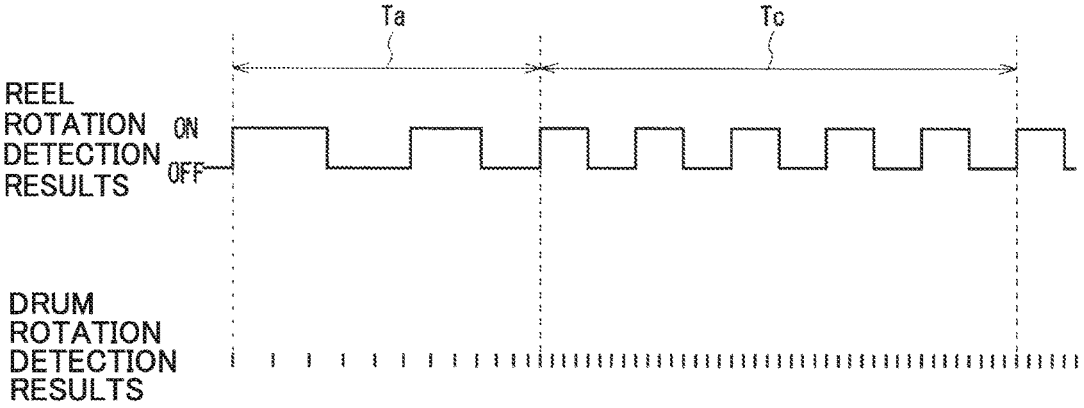
FIG. 14 is a diagram illustrating reel rotation detection results and drum rotation detection results.
Figure 15:
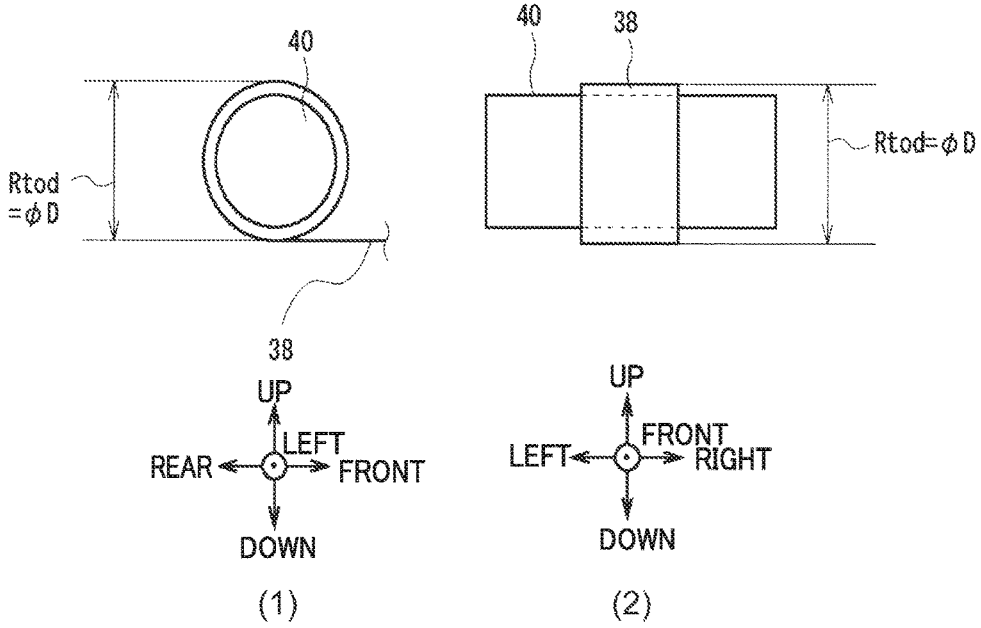
FIG. 15 illustrates configuration of the reel and the tape in a reel-and-tape lower limit state, in side view from the left (1), and in front view (2).

The motor is provided with an encoder, and a rotation amount of an output shaft of the motor may be detected as a pulse. The encoder detects the rotation amount of the motor at a resolution of $1000^{th}$ of a revolution or finer, for example, and sends pulse detection results to the retention controller 32 as drum rotation detection results, as illustrated in FIG. 14. The retention controller 32 is capable of computing the rotation amount of the drum 34 from the drum rotation detection results detected by the encoder.

A single tape drive system 36 is provided at substantially the left-right center inside the temporary retention section 20. The tape drive system 36 drives a single tape 38. The tape 38 is formed in a thin film shape having with sufficient length in its long direction, and a short direction length (namely a tape width) sufficiently shorter than the long edge of a banknote BL.

Figure 4:
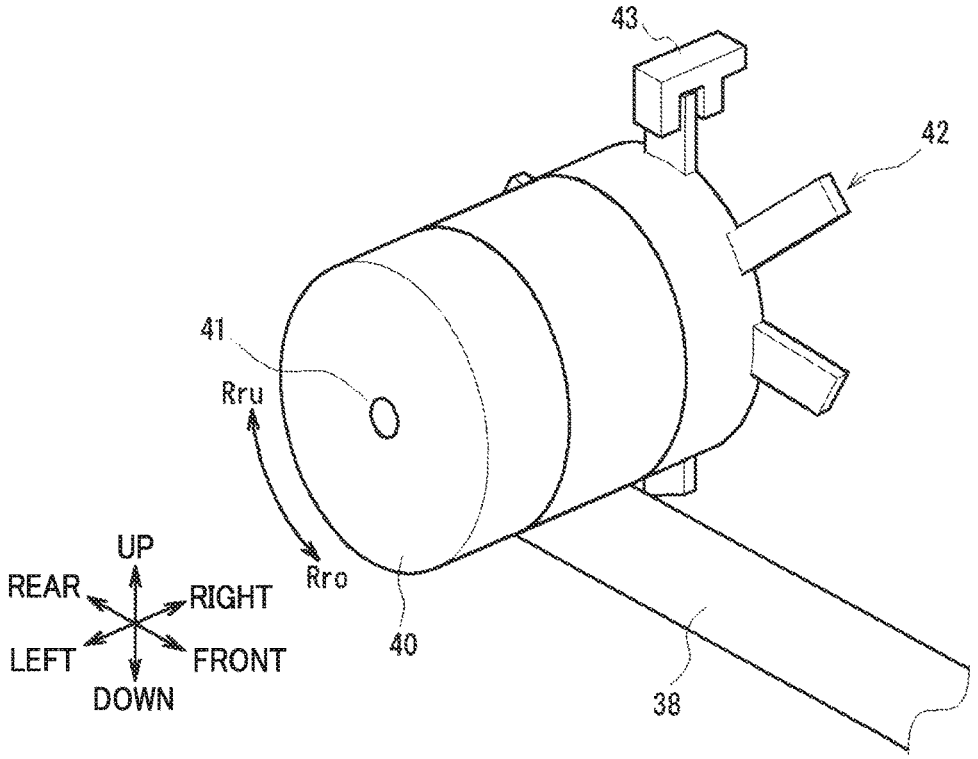
FIG. 4 is a perspective view illustrating configuration of a reel (1).
Figure 5:
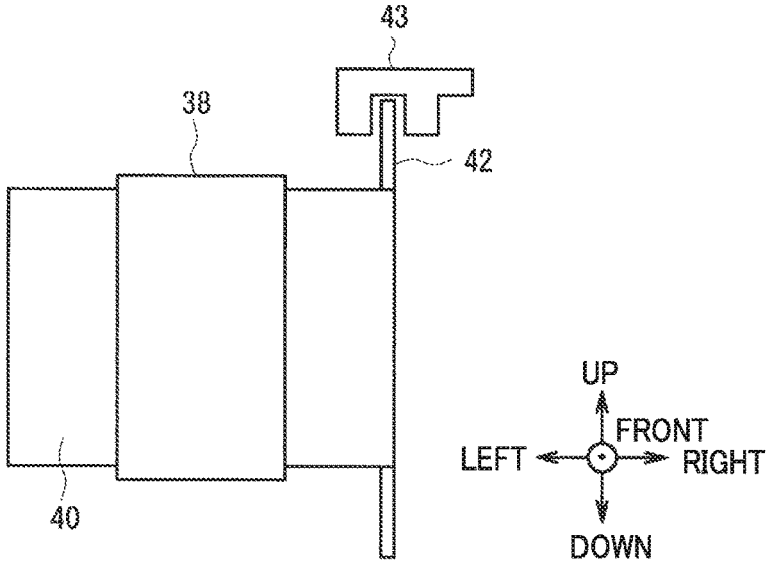
FIG. 5 is a front view illustrating configuration of a reel (2).
Figure 6:
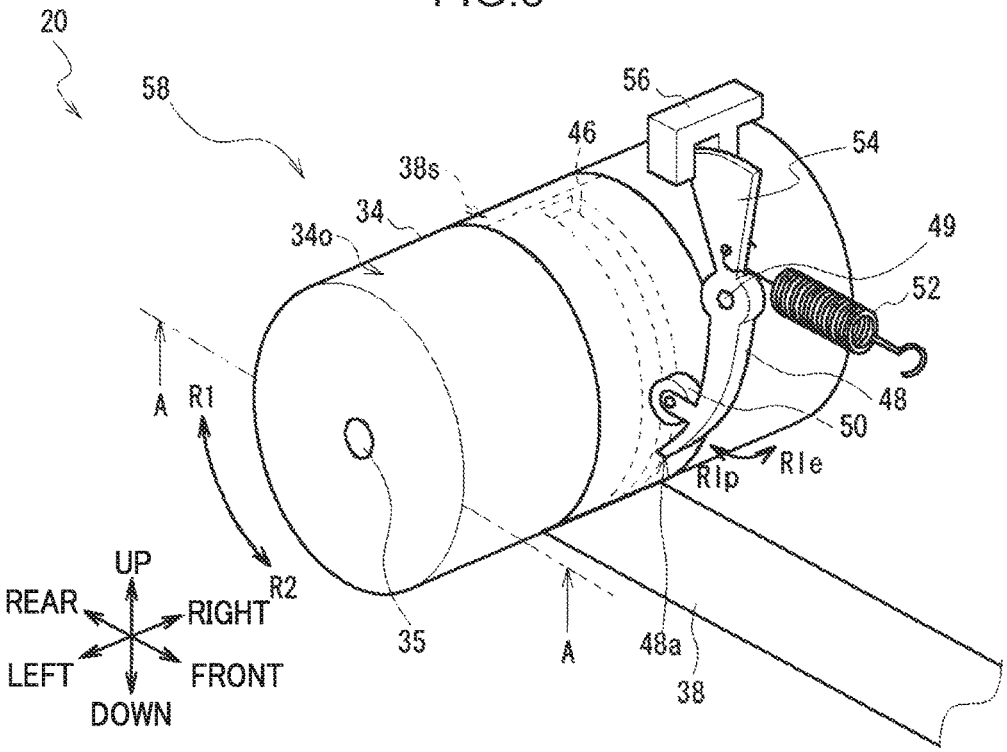
FIG. 6 is a perspective view illustrating configuration of the temporary retention section according to the first exemplary embodiment when in a rotation-permitted state (1).
Figure 7:
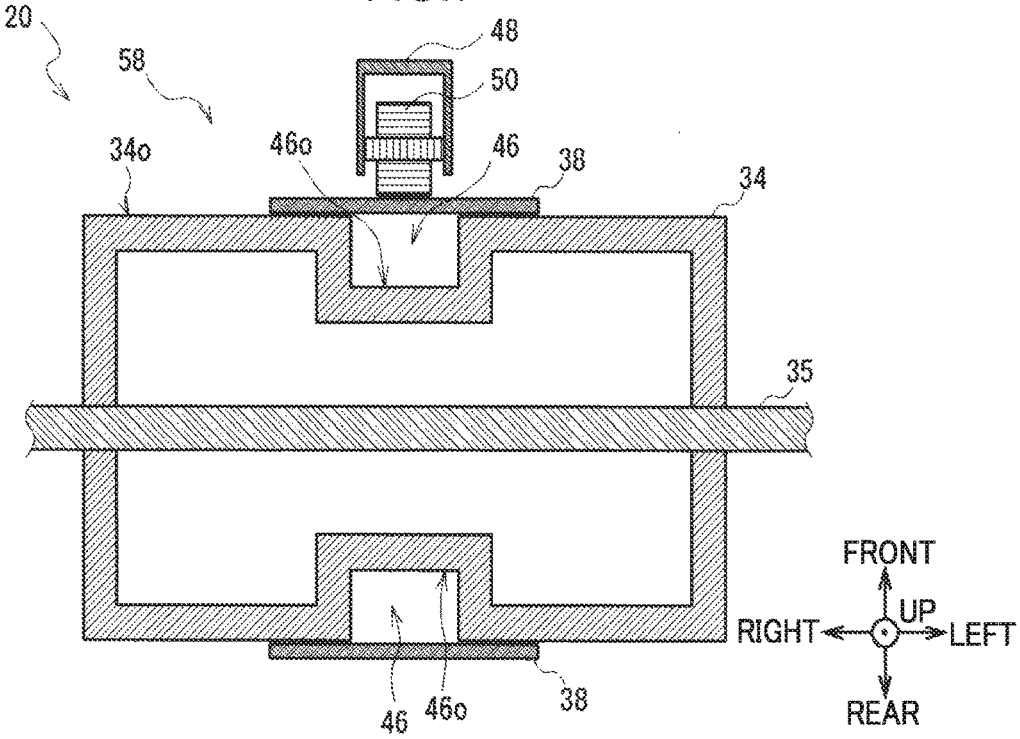
FIG. 7 is a cross-section taken along the direction indicated by the arrows A-A in FIG. 6, illustrating configuration of the temporary retention section according to the first exemplary embodiment in a rotation-permitted state (2).

A reel 40 configured in a circular cylinder spool shape as illustrated in FIG. 4 and FIG. 5 is provided at a lower side of the drum 34. The reel 40 rotates about a rotation shaft 41 that runs parallel to the rotation shaft 35 of the drum 34. A tape terminal end portion (also referred to as a tape-end), not illustrated in the drawings, configuring one end of the tape 38 is fixed to a left-right direction substantially central portion of a circumferential face of the reel 40, and the tape 38 is wound onto the reel 40. A torque limiter, not illustrated in the drawings, biases the reel 40 toward the take-up direction of the tape 38 such that the tape 38 is constantly applied with a predetermined tension. Plate shaped reel rotation detected portions 42 project out from the circumferential face at a right end portion of the reel 40 at a predetermined spacing to form a radiating pattern.

A reel rotation-detecting sensor 43 is, for example, an optical sensor with an angular C shape, disposed with a light emitting portion and a light receiving portion respectively on the left and right of a groove through which the reel rotation detected portions 42 pass. The reel rotation-detecting sensor 43 is disposed at an upper side of the reel 40. The reel rotation-detecting sensor 43 detects the presence of a reel rotation detected portion 42 by the light receiving portion detecting that light from the light emitting portion has been blocked by the reel rotation detected portion 42. The reel rotation-detecting sensor 43 sends detection results to the retention controller 32 as reel rotation detection results. As illustrated in FIG. 14, the reel rotation-detecting sensor 43 detects an OFF state as a bright state in which light from the light emitting portion is being received by the light receiving portion when the optical axis is not blocked by the reel rotation detected portions 42, and detects an ON state as a dim state in which light from the light emitting portion is not being received by the light receiving portion when the optical axis is being blocked by a reel rotation detected portion 42. The retention controller 32 computes the rotation amount of the reel 40 based on the acquired reel rotation detection results.

A pulley 44 is provided at a front side of the drum 34. The pulley 44 is formed in a circular cylinder shape and is inserted onto a shaft 45 running parallel to the rotation shaft 35 of the drum 34. The pulley 44 is capable of rotating about the shaft 45.

Figure 8:
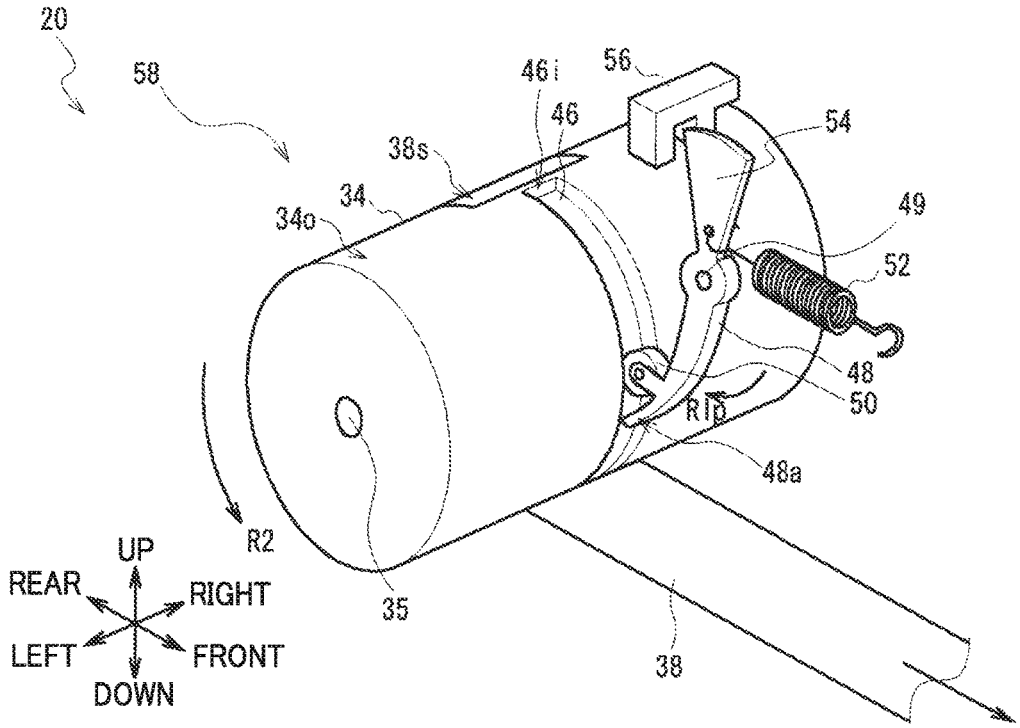
FIG. 8 is a perspective view illustrating configuration of the temporary retention section according to the first exemplary embodiment in a lever engaged state.

The tape 38 wound onto the reel 40 is pulled out upward from the reel 40, and is pulled around the pulley 44 so as to turn back on itself toward the rear. As illustrated in FIG. 8, a tape start end portion 38*s* (also referred to as the tape start), this being a leading end of the tape 38, is fixed to a left-right direction central portion of a circumferential face of the drum 34.

In the temporary retention section 20 configured in this manner, the drum 34 is rotated in the take-up direction R1 during a banknote storage operation to store banknotes. Accompanying this, the reel 40 rotates in a reel unwind direction Rro, the tape 38 moves in a tape movement direction T1, and the tape 38 is wrapped onto the circumferential face of the drum 34 in layers. When this is performed, the temporary retention section 20 sandwiches a banknote BL between the tape 38 wrapped onto the circumferential face of the drum 34 in layers, with the tape 38 present at both the inside and the outside of the banknote BL. The banknote BL is wrapped onto the circumferential face of the drum 34 together with the tape 38. Conversely, in a banknote discharge operation to discharge banknotes to the exterior of the temporary retention section 20, the reel 40 is rotated in a reel take-up direction Rru. Accompanying this, the drum 34 rotates in the unwind direction R2, the tape 38 moves in a tape movement direction T2, and the tape 38 is wrapped onto the circumferential face of the reel 40 in layers.

1-4. Configuration of Reverse-Winding Prevention Mechanism

Figure 9:
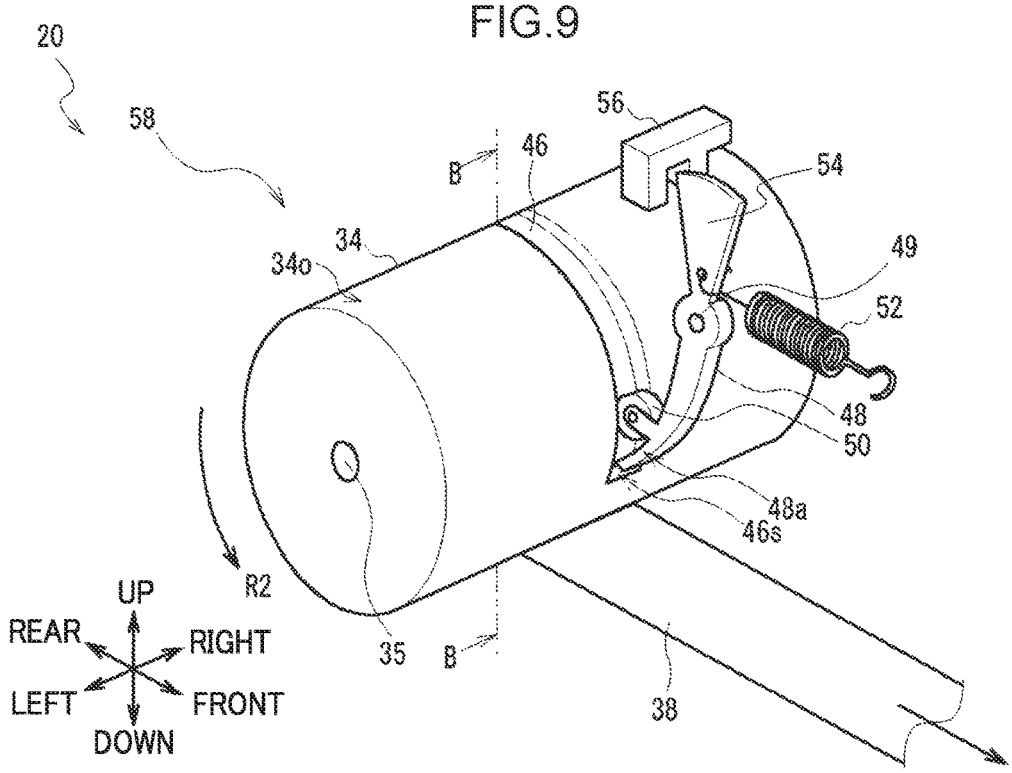
FIG. 9 is a perspective view illustrating configuration of the temporary retention section according to the first exemplary embodiment in a rotation-restricted state (1).
Figure 10:
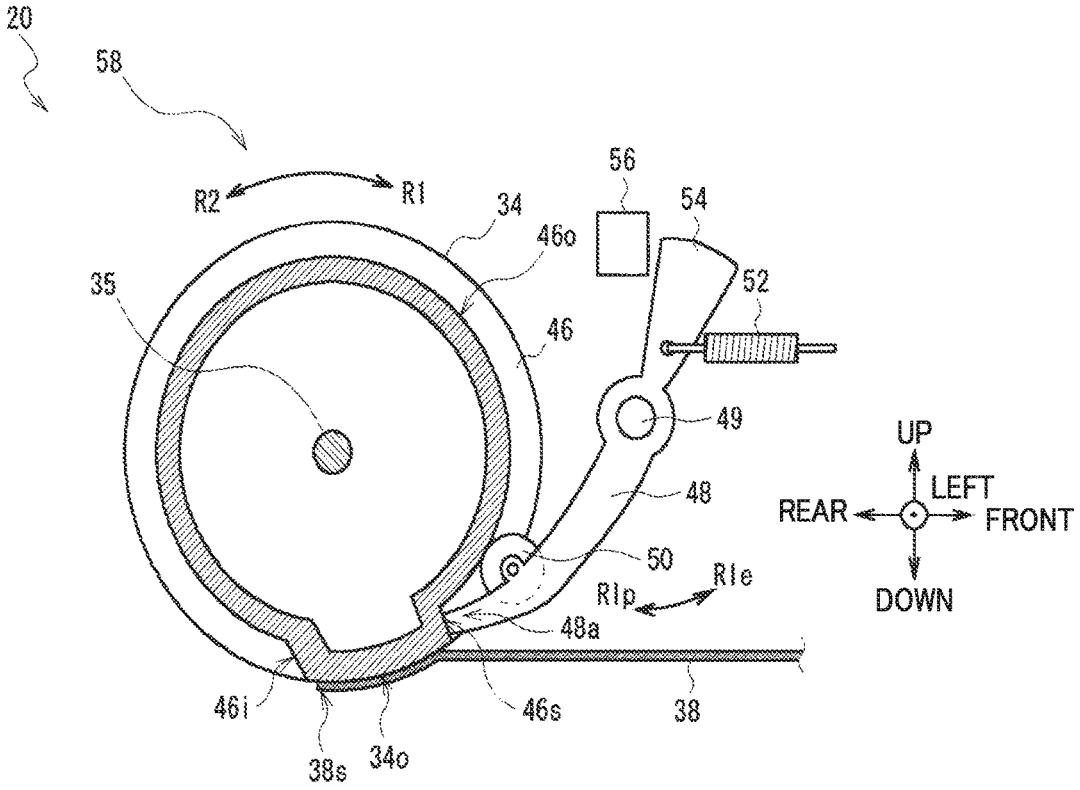
FIG. 10 is a cross-section taken along the direction indicated by the arrows B-B in FIG. 9, illustrating configuration of the temporary retention section according to the first exemplary embodiment in a rotation-permitted state (2)

As illustrated in FIG. 6 to FIG. 10, a groove 46 having a narrower width than the tape width of the tape 38 is formed at a left-right direction central portion of the outer circumference of the drum 34, namely at a location onto which the tape 38 is wound. Starting in the vicinity of a take-up direction R1 side of the tape start end portion 38*s*, this being a start end side portion where the tape 38 is fixed to a drum circumferential face 34*o*, this being an outer circumferential face of the drum 34, the groove 46 is carved out over a predetermined angle range (for example 320°) in the take-up direction R1. As illustrated in FIG. 10, an unwind direction R2 side end portion of the groove 46 is formed with a sloping face 46*i*, this being a face sloping inward from the drum circumferential face 34*o*. A groove circumferential face 46*o* is formed as a face parallel to the drum circumferential face 34*o* over a predetermined angle range (for example 320°) from a take-up direction R1 side end portion of the sloping face 46*i* toward the take-up direction R1, and a stopper face 46*s* is formed as a face facing the drum circumferential face 34*o* along the radial direction at a take-up direction R1 side end portion of the groove circumferential face 46*o*. Forming the groove 46 with the sloping face 46*i* allows the temporary retention section 20 to return from a lever engaged state in which an abutting portion 48*a* and an abutting roller 50 of a restriction lever 48, described later, have entered inside the groove 46, to a rotation-permitted state in which the restriction lever 48 does not restrict rotation of the drum 34. When the drum 34 is rotated in the take-up direction R1, the temporary retention section 20 returns to the rotation-permitted state by the abutting portion 48*a* coming out from the groove 46 as the abutting roller 50 rolls from the groove circumferential face 46*o* to the sloping face 46*i* while in contact with the groove circumferential face 46*o* and the sloping face 46*i*.

The groove 46 is not exposed to the exterior due to the tape 38 being wound around the outside of the groove 46. The tape 38 is present between the groove 46 and the restriction lever 48, such that the restriction lever 48 is restricted from pivoting in a lever approach direction Rlp, this being a direction in which the restriction lever 48 pivots so as to enter the groove 46.

The restriction lever 48 is a bar shaped member extending from an upper front side toward a lower rear side. A lower portion of the restriction lever 48 is curved so as to approach the drum 34. The restriction lever 48 is provided so as to be capable of pivoting about a lever pivot shaft 49 located in front of the drum 34, toward a lever retraction direction Rle moving away and retracting from the groove 46, or toward the lever approach direction Rlp approaching the groove 46. In the restriction lever 48, a biasing member 52 that serves as a biasing section and that is configured by a tension spring is fixed to the frame 30 (FIG. 3) at a front end and is anchored at the upper side of the lever pivot shaft 49 at a rear end, thereby biasing the lever pivot shaft 49 toward the lever approach direction Rlp about the lever pivot shaft 49. The abutting portion 48*a* that abuts the stopper face 46*s* of the groove 46 is formed at a lower end portion of the restriction lever 48. The restriction lever 48 is also provided with the abutting roller 50, located slightly above the abutting portion 48*a*. The abutting roller 50 is provided capable of rotating so as to roll while in contact with the outer circumferential face of the tape 38 when in the rotation-permitted state, and so as to roll while in contact with the groove circumferential face 46*o* of the groove 46 when in the lever engaged state.

The abutting portion 48*a* is configured so as not to contact the tape 38 when the abutting roller 50 is rolling while in contact with an outer circumferential face of the tape 38, and so as not to contact the groove circumferential face 46*o* when the abutting roller 50 is rolling while in contact with groove circumferential face 46*o*. This enables the restriction lever 48 to be configured such that the abutting portion 48*a* does not contact the tape 38, enabling wear of the tape 38 as a result of the drum 34 rotating with the abutting portion 48*a* contacting the tape 38 to be prevented. Moreover, a plate shaped lever detected portion 54 is provided at the upper side of the lever pivot shaft 49 of the restriction lever 48.

A lever detection sensor 56 is, for example, an optical sensor with an angular C shape, with a light emitting portion and a light receiving portion disposed on the left and right of a groove through which the lever detected portion 54 passes. The lever detection sensor 56 is disposed at the upper side of the lever pivot shaft 49. The lever detection sensor 56 detects the presence of the lever detected portion 54 by detecting that light from the light emitting portion has been blocked by the lever detected portion 54, and thereby detects whether the restriction lever 48 is in a retracted state retracted from the groove 46, or in the engaged state inside the groove 46. The lever detection sensor 56 sends detection results to the retention controller 32 as lever detection results. The lever detection sensor 56 detects an OFF state as a bright state in which light from the light emitting portion is being received by the light receiving portion when the optical axis is not blocked by the lever detected portion 54, and detects an ON state as a dim state in which light from the light emitting portion is not being received by the light receiving portion when the optical axis is being blocked by the lever detected portion 54. The retention controller 32 is capable of detecting the state of the restriction lever 48 from the lever detection results detected by the lever detection sensor 56. The lever detection sensor 56 detects the ON state when in the rotation-permitted state illustrated in FIG. 6 and FIG. 7.

The groove 46 of the drum 34 and the restriction lever 48 form a reverse-winding prevention mechanism 58 that prevents reverse-winding in which, after the tape start end portion 38*s* has been reached and exposed by continued rotation of the drum 34 in the unwind direction R2, the drum 34 continues to rotate in the unwind direction R2 and the tape 38 is wound onto the drum 34 along the take-up direction R1.

In this configuration, when the drum 34 rotates toward the unwind direction R2 and the tape start end portion 38*s* is exposed due to moving further in the unwind direction R2 than a position overlapped by the tape 38, the tape 38 comes away from the groove 46, thereby exposing the groove 46. The tape 38, which has been previously restricting movement of the restriction lever 48 in the lever approach direction Rlp, is therefore no longer present at the outside of the groove 46, and so the restriction lever 48 pivots toward the lever approach direction Rlp, and the abutting portion 48*a* and the abutting roller 50 rolling against the sloping face 46*i* enter the groove 46 as illustrated in FIG. 8, thereby adopting the lever engaged state. When this occurs, the lever detected portion 54 pivots about the lever pivot shaft 49 to a position away from the optical axis of the lever detection sensor 56. The lever detection sensor 56 accordingly detects the OFF state.

When the retention controller 32, serving as a controller, is notified of the OFF state by the lever detection sensor 56, the retention controller 32 stops rotation of the motor. The retention controller 32 sets the state of the drum 34 at the point in time when the OFF state has been notified by the lever detection sensor 56 as an engaged state that is taken as a reference (described in detail later).

When the motor is stopped under the control of the retention controller 32, the drum 34 comes to a stop after continuing to rotate for a time. When this occurs, the abutting roller 50 rotates while in contact with the groove circumferential face 46*o*, but a leading end of the abutting portion 48*a* does not contact the groove circumferential face 46*o*. The drum 34 comes to a stop before the stopper face 46*s* of the groove 46 contacts the abutting portion 48*a* of the restriction lever 48.

In a case in which a technician, for example, manually rotates the drum 34 in the unwind direction R2 from this state, as illustrated in FIG. 9 and FIG. 10, the stopper face 46*s* of the groove 46 of the drum 34 would abut the abutting portion 48*a* of the restriction lever 48. The abutting portion 48*a* is biased toward the groove circumferential face 46*o* and the stopper face 46*s* by the biasing member 52, and continues to abut the stopper face 46*s* without the restriction lever 48 coming out of the groove 46, even if the restriction lever 48 is applied with force in the unwind direction R2 direction from the drum 34. Rotation of the drum 34 in the unwind direction R2 accordingly continues to be restricted.

In this manner, due to the restriction lever 48 abutting the stopper face 46*s*, the temporary retention section 20 is capable of preventing rotation of the drum 34 in the unwind direction R2 from a state in which the tape 38 is not wrapped onto the drum 34, even if force to rotate the drum 34 in the unwind direction R2 is applied by a technician or the like. Reverse-winding may accordingly be prevented.

In a hypothetical case in which the temporary retention section 20 did not check lever detection results and stop the motor, on reaching a state in which the tape 38 is not wound onto the drum 34, the abutting portion 48*a* of the restriction lever 48 would suddenly strike the stopper face 46*s* of the groove 46 with the drum 34 rotating at high speed, thereby stopping rotation of the drum 34 abruptly. This may damage the tape 38.

However, configuration is made such that the temporary retention section 20 stops rotation of the motor when the lever engaged state has been reached. In the temporary retention section 20, even if there is some rotation of the drum 34 until actually coming to a stop after stopping the motor, and the abutting portion 48*a* of the restriction lever 48 abuts the stopper face 46*s* of the groove 46, the rotation of the drum 34 would already have slowed, enabling the rotation of the drum 34 to be stopped while preventing damage to the tape 38.

1-5. Possible Reel Revolutions Computation Operation

The retention controller 32 performs a possible reel revolutions computation operation, described later, in order to compute the remaining length of the tape 38 wound around the reel 40, and prevent the reel 40 from being rotated further in the reel unwind direction Rro after the tape terminal end portion has been reached. The retention controller 32 performs the possible reel revolutions computation operation in a state in which there are no banknotes wound onto the drum 34, such as when the power of the ATM 1 is turned on, or after a technician has performed a maintenance or inspection operation on the ATM 1.

Figure 11:
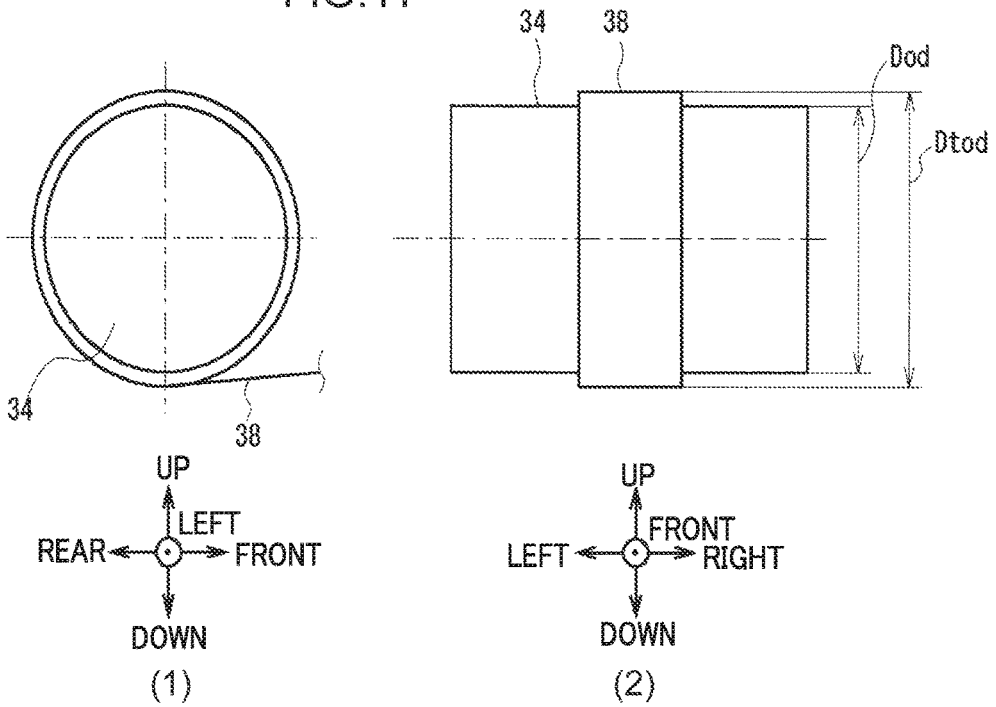
FIG. 11 illustrates configuration of a drum and a tape in side view from the left (1), and in front view (2).
Figure 12:
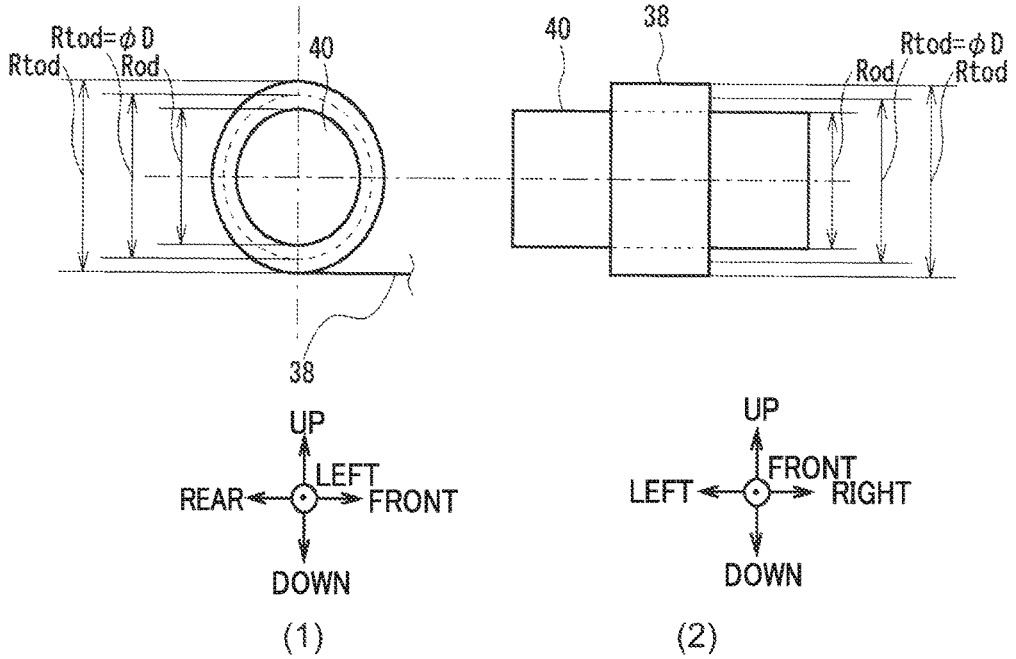
FIG. 12 illustrates configuration of a reel and the tape in side view from the left (1), and in front view (2).

As illustrated in FIG. 11, the outer diameter of the drum 34 itself is denoted the drum outer diameter Dod, and the apparent outer diameter of the drum 34 in a state in which the tape 38 has been wound onto the drum 34 is denoted the drum-and-tape outer diameter Dtod. Moreover, in order to avoid exposing the tape terminal end portion, a state in which there is some spare tape 38 wound onto the reel 40, as a buffer against a state in which the tape terminal end portion is exposed, is set as a reel lower limit state. As illustrated in FIG. 12, the outer diameter of the reel 40 itself is denoted the reel outer diameter Rod, and the reel outer diameter Rod in a state in which a minimum usable amount of the tape 38 as indicated by the reel lower limit state is wound onto the reel 40 is denoted a reel-and-tape lower limit outer diameter value ϕD. The apparent outer diameter of the reel 40 in a state in which the tape 38 has been wound onto the reel 40 is denoted a reel-and-tape outer diameter Rtod. Moreover, the thickness of the tape 38 is denoted the tape thickness Tt.

1-5-1. Initial Position Finding Operation

First, the retention controller 32 performs the following initial position finding operation. The retention controller 32 rotates the reel 40 in the reel take-up direction Rru, such that the drum 34 is rotated in the unwind direction R2, and when the lever engaged state is detected, the rotation of the drum 34 is stopped. Next, starting from the engaged state, the retention controller 32 rotates the drum 34 in the take-up direction R1, such that the reel 40 is rotated in the reel unwind direction Rro, and, for example, three meters of the tape 38 are wound onto the drum 34. This state is taken as an initial reference state. Setting is made such that the drum-and-tape outer diameter Dtod is 70 mm in the initial reference state.

Figure 13:
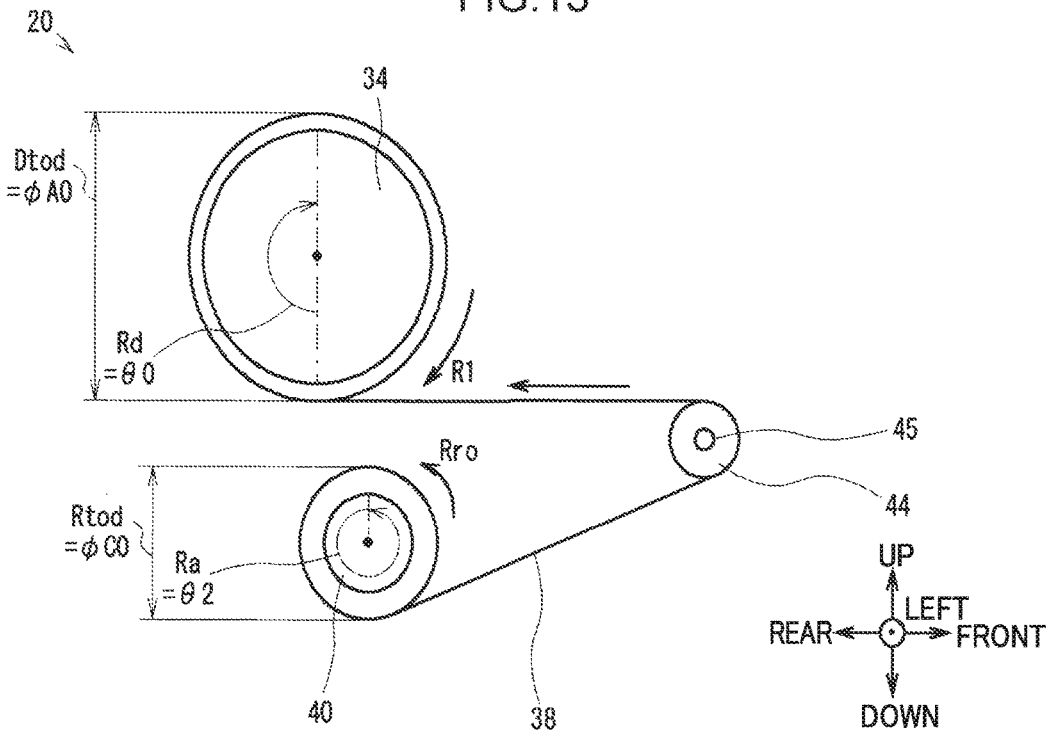
FIG. 13 is a side view from the left illustrating movement of the drum, reel, and tape in a possible reel revolutions computation operation.

Next, as illustrated in FIG. 13, the retention controller 32 rotates the drum 34 in the take-up direction R1 by a predetermined rotation angle, such that the reel 40 is rotated toward the reel unwind direction Rro by θ2 (for example 360°) as a reel rotation angle Ra. In reality, as illustrated in FIG. 14, when the motor is rotated, the drum 34 and the reel 40 accelerate during an acceleration period Ta, and after a certain amount of time, transition from the acceleration period Ta to a constant speed period Tc during which the speed remains constant. In the constant speed period Tc, the retention controller 32 begins counting the number of pulses of the reel rotation detection results and the drum rotation detection results, and when a predetermined n pulses of the reel rotation detection results indicating the ON state have been detected, the reel 40 is considered to have rotated through the set predetermined angle, and counting of the pulses (m pulses) of the drum rotation detection results is ended. Specifically, in the present exemplary embodiment, the reel 40 is rotated through 360° as θ2 for the reel rotation angle Ra, and so the retention controller 32 computes θ0 as a drum rotation angle Rd, this being a rotation angle of the drum 34 corresponding to the number of pulses, based on the number of pulses of the drum rotation detection results measured from the start of counting of the reel rotation detection results and the drum rotation detection results up until the point in time when a predetermined number of pulses (for example six pulses) of the reel rotation detection results have been detected. In this manner, the retention controller 32 rotates the drum 34 by θ0 in the take-up direction R1 from the initial reference state as the drum rotation angle Rd, such that the reel 40 is rotated by θ2 in the reel unwind direction Rro as the reel rotation angle Ra. When this is performed, the value of the drum-and-tape outer diameter Dtod becomes ϕA0, and the value of the reel-and-tape outer diameter Rtod becomes ϕC0. Since no banknotes BL have been wound onto the drum 34, the value of the drum-and-tape outer diameter Dtod will always be ϕA0, even if a tape-and-reel thickness computation operation is subsequently performed again.

Note that there is a possibility of slack being present in the tape 38 between the drum 34 and the reel 40 when the initial position finding operation commences. There may therefore be a possibility of the ratio between the rotation angles of the drum 34 and the reel 40 being inconsistent with the settings. For this reason, the retention controller 32 does not count the pulses during the acceleration period Ta, but counts the pulses following transition to the constant speed period Tc, once the ratio between the rotation angles of the drum 34 and the reel 40 have become consistent with the settings.

1-5-2. Reel Remaining Tape Measurement Operation

At this point, since the length of the tape 38 wound onto the drum 34 is equal to the length of the tape 38 unwound from the reel 40, the following Equation (1) is satisfied:

$$\phi A0\pi\times\theta0/360=\phi C0\pi\times\theta2/360\therefore\phi C0=\phi A0\times\theta0/\theta2 \quad (1)$$

ϕC0, this being the reel-and-tape outer diameter Rtod, is computed using Equation (1). Note that a usable range of the tape 38 extends up to a point where the reel-and-tape outer diameter Rtod reaches the reel-and-tape lower limit outer diameter value ϕD. From where the reel-and-tape outer diameter Rtod falls below the reel-and-tape lower limit outer diameter value ϕD, up to a point where the reel-and-tape outer diameter Rtod becomes the reel outer diameter Rod, corresponds to the portion of the tape 38 wound onto the reel 40 as a buffer. Accordingly, following a state in which the initial position finding operation has been performed, an amount of the usable tape 38 corresponding to the reel-and-tape outer diameter Rtod minus the reel-and-tape lower limit outer diameter value ϕD is wound onto the reel 40. The retention controller 32 is thus capable of ascertaining the amount of tape 38 that remains wound onto the reel 40.

An initial value G0 of the number of remaining revolutions Nr of the reel 40 able to be rotated from the current state of the reel 40 until the reel-and-tape outer diameter Rtod reaches the reel-and-tape lower limit outer diameter value ϕD is expressed by the following Equation (2).

$$G0=((\phi C0-\phi D)/2)/Tt \quad (2)$$

During subsequent banknote storage operations and banknote discharge operations, the retention controller 32 increases or decreases the number of remaining revolutions Nr by detecting the number of revolutions of the reel 40 using the reel rotation detected portions 42, and detecting the rotation direction of the reel 40 from the rotation direction of the motor. Namely, in a banknote storage operation, the retention controller 32 decreases the number of remaining revolutions Nr by one each time the reel 40 completes one revolution since the reel 40 is rotated in the reel unwind direction Rro to unwind the tape 38 from the reel 40. On the other hand, in a banknote discharge operation, the retention controller 32 increases the number of remaining revolutions Nr by one each time the reel 40 completes one revolution since the reel 40 is rotated in the reel take-up direction Rru to take up the tape 38 onto the reel 40. In a banknote storage operation, the retention controller 32 stops the motor when the number of remaining revolutions Nr has reached zero.

Due to the retention controller 32 performing the possible reel revolutions computation operation described above, it is possible to prevent the tape 38 wound onto the reel 40 from being unwound completely. However, when banknote storage operations and banknote discharge operations are performed repeatedly after performing the initial position finding operation, a margin of error may arise between the actual number of possible revolutions, and the computed number of remaining revolutions Nr, of the reel 40 until the reel-and-tape outer diameter Rtod reaches the reel-and-tape lower limit outer diameter value ϕD. Accordingly, the retention controller 32 repeats the possible reel revolutions computation operation at a predetermined timing, such as when the power of the ATM 1 is turned on, or after a maintenance or inspection operation of the ATM 1 has been performed by a technician. This thereby enables the margin of error between the actual number of possible revolutions, and the computed number of remaining revolutions Nr, of the reel 40 until the reel-and-tape outer diameter Rtod reaches the reel-and-tape lower limit outer diameter value ϕD to be reduced, thereby enabling the tape 38 wound onto the reel 40 to be reliably prevented from unwinding completely.

1-6. Tape Length Computation Operation

The retention controller 32 computes the length of the tape 38 by performing the following tape length computation operation. The retention controller 32 performs the tape length computation operation in a state in which no banknotes have been wound onto the drum 34, such as when the power of the ATM 1 is turned on, or after a maintenance or inspection operation of the ATM 1 has been performed by a technician.

Figure 16A:
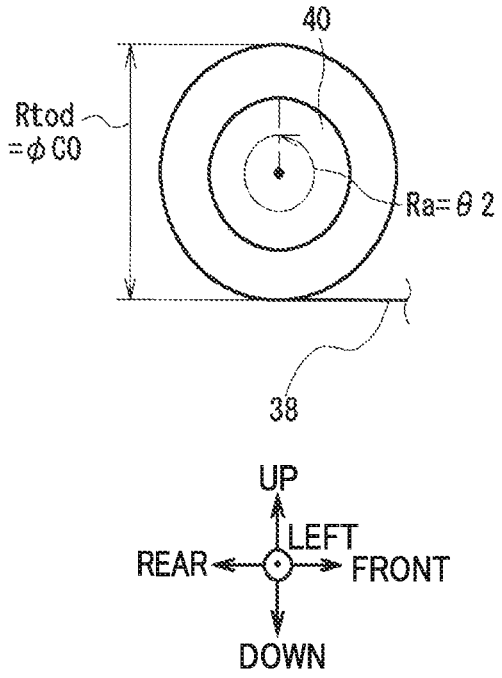
FIG. 16A is a side view from the left illustrating configuration of the reel and tape in a tape length computation operation.

First, the retention controller 32 performs the initial position finding operation of the possible reel revolutions computation operation described above, and stores θ2 in the retention storage section 33 as the reel rotation angle Ra, as illustrated in FIG. 16A, and stores θ0 in the retention storage section 33 as the drum rotation angle Rd.

Figure 16B:
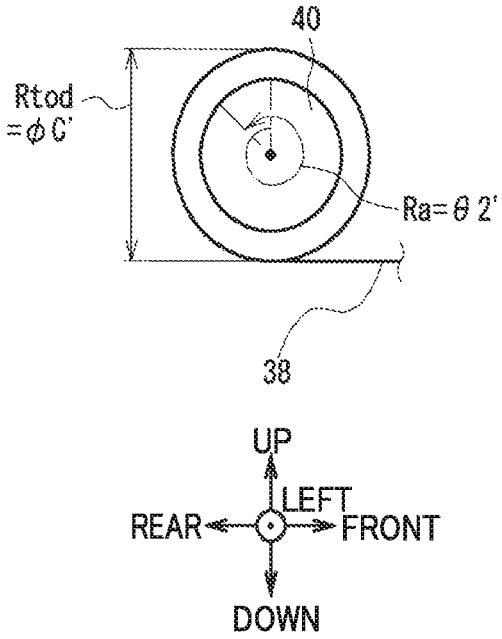
FIG. 16B is a side view from the left illustrating configuration of the reel and tape in a tape length computation operation.

Next, the retention controller 32 performs banknote storage operations and banknote discharge operations. In a banknote storage operation, the retention controller 32 detects the rotation angle of the reel 40 again when the drum 34 has been rotated in the take-up direction R1 by θ0, this being the drum rotation angle Rd. Suppose that the reel rotation angle Ra at this point is θ2', as illustrated in FIG. 16B. When the drum 34 is rotated in the take-up direction R1 by the constant angle θ0, the length of tape 38 unwound from the reel 40 is also constant, and so in cases in which θ2' has changed by a predetermined amount or greater with respect to θ2, the retention controller 32 determines that there has been a change in the length of the tape 38 compared to when the initial position finding operation has been performed. Namely, as illustrated in FIG. 16A and FIG. 16B, in cases in which θ2' is greater than θ2 by a predetermined amount or greater, the retention controller 32 determines that the tape length has become shorter, and in cases in which θ2' is smaller than θ2 by a predetermined amount or greater, the retention controller 32 determines that the tape length has become longer.

A change in the tape length is conceivable in, for example, a case in which a technician has rejoined the tape 38 after the tape 38 has snapped, reducing the total length of the tape 38. In such cases, if the retention controller 32 uses the value G0 of the number of remaining revolutions Nr determined in the reel remaining tape measurement operation as-is in a banknote storage operation or banknote discharge operation, there would be a possibility of the tape 38 wound onto the reel 40 running out during the operation, causing a device error. For this reason, when θ2' has changed by a predetermined amount or greater compared to θ2, in Equation (1) described above, the retention controller 32 replaces θ2 with θ2', to find ϕC' instead of ϕC0, and in Equation (2) described above, replaces ϕC0 with ϕC' to find G' instead of G0. Subsequently, banknote storage operations and banknote discharge operations are performed using G' as the new number of remaining revolutions Nr.

Moreover, particularly in cases in which the tape 38 has become shorter, the number of banknotes that may be stored in the temporary retention section 20 decreases in comparison to the pre-designed number. Accordingly, the retention controller 32 sends a warning to the banknote controller 12 prompting replacement of the tape 38.

In this manner, the temporary retention section 20 compares the reel rotation angle Ra θ2 with respect to the drum rotation angle Rd θ0 detected in the initial position finding operation against the reel rotation angle Ra θ2' with respect to the drum rotation angle Rd θ0 during banknote storage operations and banknote discharge operations. In cases in which θ2' has changed by the predetermined amount or greater with respect to θ2, the length of the tape 38 is determined to have changed from when the initial position finding operation has been performed as an initialization operation.

Accordingly, in cases in which the tape length has changed during running of the ATM 1, the temporary retention section 20 is capable of detecting this change and modifying the control during banknote storage operations and banknote discharge operations. In particular, the occurrence of faults due to the tape 38 becoming shorter may be prevented. Moreover, the temporary retention section 20 is capable of performing an alarm notification in cases in which a change in the tape length has been detected, enabling a response such as replacing the tape 38 or limiting the number of banknotes in a transaction to be taken swiftly.

1-7. Effects

In a conventional temporary retention section 1020 (FIG. 30 to FIG. 34), it is possible that reverse-winding may occur if, for example, a technician made the operational mistake of manually rotating the drum 34 in the unwind direction R2 in an attempt to release banknotes in a jam, regardless of a tape start end portion 1038*s* being exposed, or if the motor were to run out of control due to a fault in the various sensors inside the temporary retention section 1020.

By contrast, in the temporary retention section 20, the tape 38 is wound around the circumferential outside of the groove 46 of the drum 34, and the restriction lever 48 is biased in the lever approach direction Rlp toward the groove 46. When the tape start end portion 38*s* is reached and the tape 38 comes away from the groove 46, the abutting portion 48*a* of the restriction lever 48 enters the groove 46, and the rotation of the drum 34 is stopped when the physical action of the restriction lever 48 has been detected by the lever detection sensor 56.

Accordingly, the temporary retention section 20 is capable of stopping the drum 34 based on the physical action at virtually the same time as the tape start end portion 38*s* is exposed and a portion of the drum 34 around which no tape 38 is wrapped emerges. This thereby enables reverse-winding to be reliably prevented.

Moreover, in the temporary retention section 20, if the drum 34 that is in the process of stopping rotates after the abutting portion 48*a* of the restriction lever 48 has entered the groove 46, the stopper face 46*s* abuts the abutting portion 48*a* continuously, thereby enabling rotation of the drum 34 in the unwind direction R2 to be restricted, and enabling reverse-winding to be more reliably prevented.

Moreover, in the temporary retention section 20, the groove 46 is carved out over the predetermined angle range of approximately 320° from the sloping face 46*i* toward the take-up direction R1. Accordingly, in the temporary retention section 20, after adopting the lever engaged state and stopping rotation of the motor, the drum 34 may be more reliably brought to a stop before the stopper face 46*s* of the groove 46 contacts the abutting portion 48*a* of the restriction lever 48 than in cases in which the groove 46 is carved out over a shorter length than 320° from the sloping face 46*i* toward the take-up direction R1.

In order to prevent reverse-winding occurring due to operational mistakes by a technician, there have been proposals to allow a technician to perform an operation to rotate the drum 34 in the take-up direction R1, but to prevent a technician from performing an operation to rotate the drum 34 in the unwind direction R2, even in a state in which banknotes are being stored on the drum 34. However, this is inconvenient since the technician is unable to perform an operation to release banknotes from the temporary retention section 20.

By contrast, in the temporary retention section 20, the technician is capable of performing operations to rotate the drum 34 in either the take-up direction R1 or the unwind direction R2 until the tape start end portion 38*s* is exposed. This thereby enables the user-friendliness of the temporary retention section 20 to be maintained.

Figure 31:
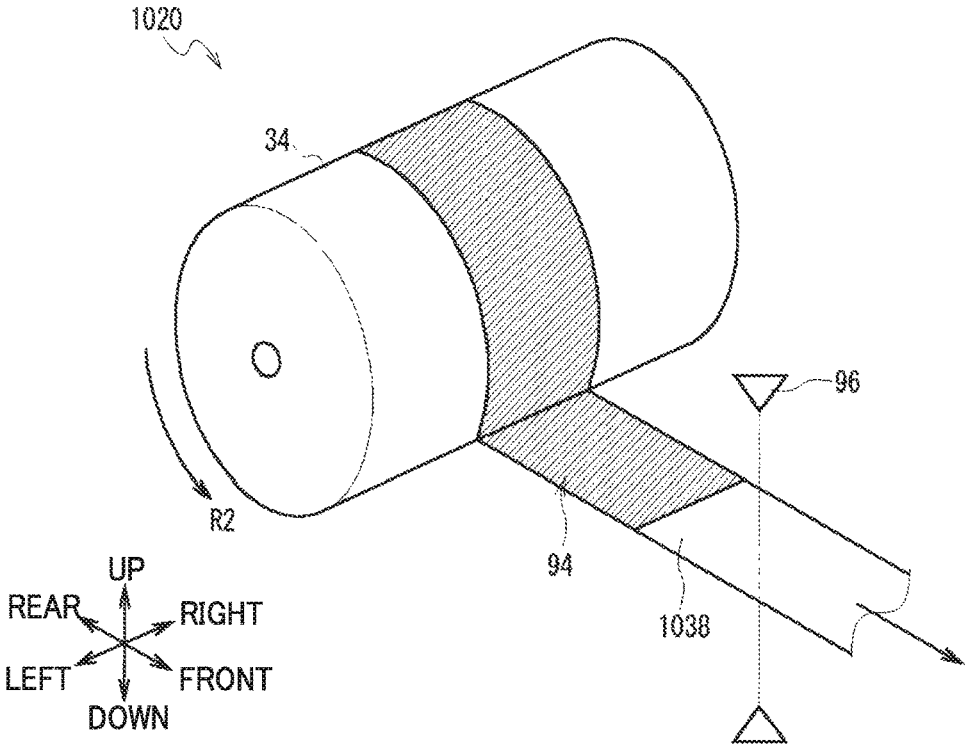
FIG. 31 is a perspective view illustrating configuration of the conventional temporary retention section (2).
Figure 32:
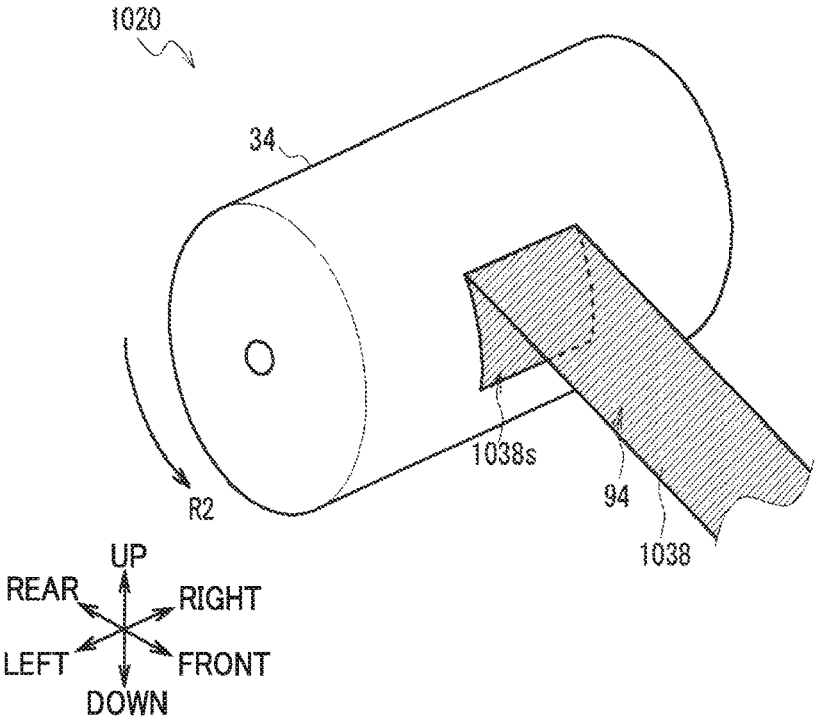
FIG. 32 is a perspective view illustrating configuration of the conventional temporary retention section (3).
Figure 33:
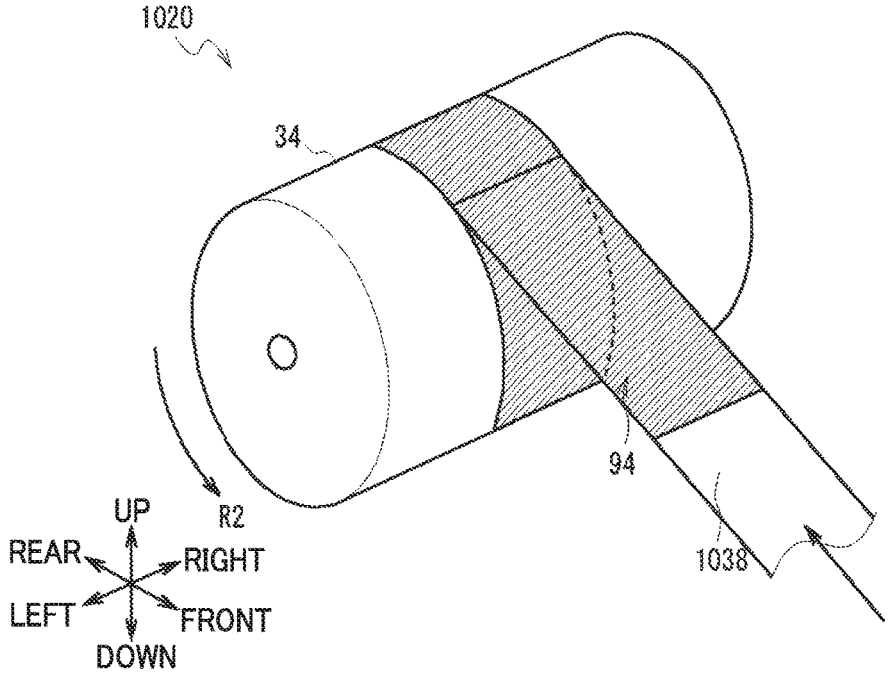
FIG. 33 is a perspective view illustrating configuration of the conventional temporary retention section (4).
Figure 34:
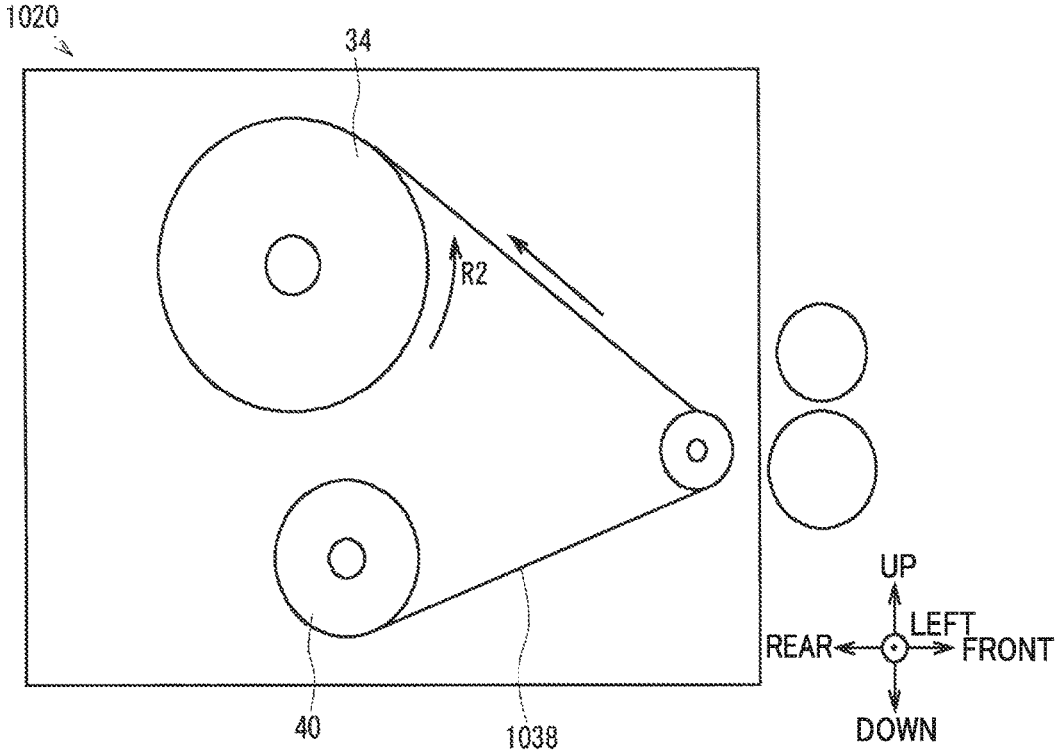
FIG. 34 is a side view from the left illustrating configuration of the conventional temporary retention section (5).

Moreover, conventionally, as illustrated in FIG. 31 to FIG. 33, light-blocking tape 94 is laminated onto a transparent tape 1038 in the vicinity of the tape start end portion 1038*s* and the tape terminal end portion (not illustrated in the drawings) fixed to the reel 40. The tape start end portion 1038*s* and the tape terminal end portion are monitored by detecting whether or not an optical axis of an optical sensor 96 is being blocked by the light-blocking tape 94.

By contrast, in the temporary retention section 20, rather than monitoring the tape 38, the tape start end portion 38*s* is monitored using the detection results of the lever detection sensor 56, and the tape terminal end portion is monitored by finding the reel-and-tape outer diameter Rtod and computing the number of remaining revolutions Nr.

Accordingly, the temporary retention section 20 is capable of detecting the start end portion of the tape 38 without affixing light-blocking tape to the start end portion side of the tape 38, and rotation of the drum 34 may be stopped before the tape 38 wound onto the drum 34 being unwound completely. Accordingly, in the temporary retention section 20, it is possible to prevent false detection of the arrival of the light-blocking tape due to the optical axis of the optical sensor being blocked by paper dust, paper scraps, or dirt adhering to the tape 38 at locations to which the light-blocking tape is not affixed. It is also possible to prevent an increase in costs attributable to the addition of light-blocking tape to the tape 38, and since the tape 38 may be made thinner by an amount commensurate with the thickness of the light-blocking tape, the drum-and-tape outer diameter Dtod of the drum 34 may be made smaller, enabling a reduction in size of the temporary retention section 20.

Moreover, in the temporary retention section 20, the ϕC0 is computed as the reel-and-tape outer diameter Rtod based on the ratio between the rotation angle of the drum 34 and the rotation angle of the reel 40 when the drum 34 has been rotated through the predetermined angle from the initial reference state. The number of remaining revolutions Nr is computed using the computed φC0 based on the preset tape thickness Tt and the reel-and-tape lower limit outer diameter value φD.

The temporary retention section 20 is accordingly capable of detecting the tape terminal end portion on the reel 40 without affixing light-blocking tape to the tape 38, and is capable of stopping rotation of the drum 34 before the tape 38 wound onto the reel 40 being unwound completely. Accordingly, the temporary retention section 20 is capable of preventing false detection of the arrival of the light-blocking tape due to the optical axis of the optical sensor being blocked by paper dust, paper scraps, or dirt adhering to the tape 38 at locations where the light-blocking tape is not affixed. It is also possible to prevent an increase in costs attributable to the addition of light-blocking tape to the tape 38, and since the tape 38 may be made thinner by an amount commensurate with the thickness of the light-blocking tape, the reel-and-tape outer diameter Rtod of the reel 40 may be made smaller, enabling a reduction in size of the temporary retention section 20.

In this manner, the temporary retention section 20 is capable of stopping the drum 34 before the tape 38 wound onto the drum 34 unwinds completely, and before the tape 38 wound onto the reel 40 unwinds completely, without affixing light-blocking tape in the vicinity of the tape start end portion 38*s* and in the vicinity of the tape terminal end portion. Accordingly, in the temporary retention section 20, the tape materials are less limited than in cases in which the tape 38 is monitored to detect the start end portion and the terminal end portion, enabling a greater degree of freedom to select tapes such as an opaque tape that is easily visible, or a patterned tape.

Moreover, in the event of a tape jam or the like, a technician may take emergency action such as cutting and rejoining the tape 38, so the length of the tape 38 does not necessary always remain constant. For this reason, it has conventionally been thought that there is no way to monitor the tape terminal end portion other than by monitoring the tape itself.

By contrast, in the temporary retention section 20, in the possible reel revolutions computation operation, the amount of tape that remains wound onto the reel 40 may be calculated and ascertained, enabling rotation of the drum 34 to be stopped when the reel terminal end portion is approached, without being affected by the tape length.

Due to the above configuration, the temporary retention section 20 is provided with the drum 34 that is configured in a circular cylinder shape and rotates about the rotation shaft 35, the tape 38 that, together with banknotes BL to be stored, is wrapped onto the drum circumferential face 34*o*, and the reel 40 onto which the tape 38 is pre-wound, and from which the tape 38 is pulled out accompanying rotation of the drum 34. The temporary retention section 20 is also provided with the reverse-winding prevention mechanism 58 that includes the restriction lever 48 serving as a restriction section that is obstructed from moving by the tape 38 wrapped onto the drum circumferential face 34*o*, and that moves when the drum 34 rotates in the unwind direction R2 to unwind the tape 38 such that the tape 38 comes away from the drum circumferential face 34*o* to expose a wrapping location of the tape 38 onto the drum circumferential face 34*o*, and the stopper face 46*s* of the groove 46 serving as a stopper section that abuts the restriction lever 48 so as to restrict rotation of the drum 34 in the unwind direction R2. This thereby enables the temporary retention section 20 to prevent reverse-winding of the drum 34 when the tape 38 is unwound as far as the tape start end portion 38*s*.

2. Second Exemplary Embodiment

2-1. Configuration of Banknote Pay-in/Pay-Out Device

As illustrated in FIG. 1 and FIG. 2, a banknote pay-in/pay-out device 110 of an ATM 101 according to a second exemplary embodiment has a similar configuration as the banknote pay-in/pay-out device 10 of the ATM 1 of the first exemplary embodiment, except in that a temporary retention section 120 differs from the temporary retention section 20.

2-2. Configuration of Temporary Retention Section

Figure 17:
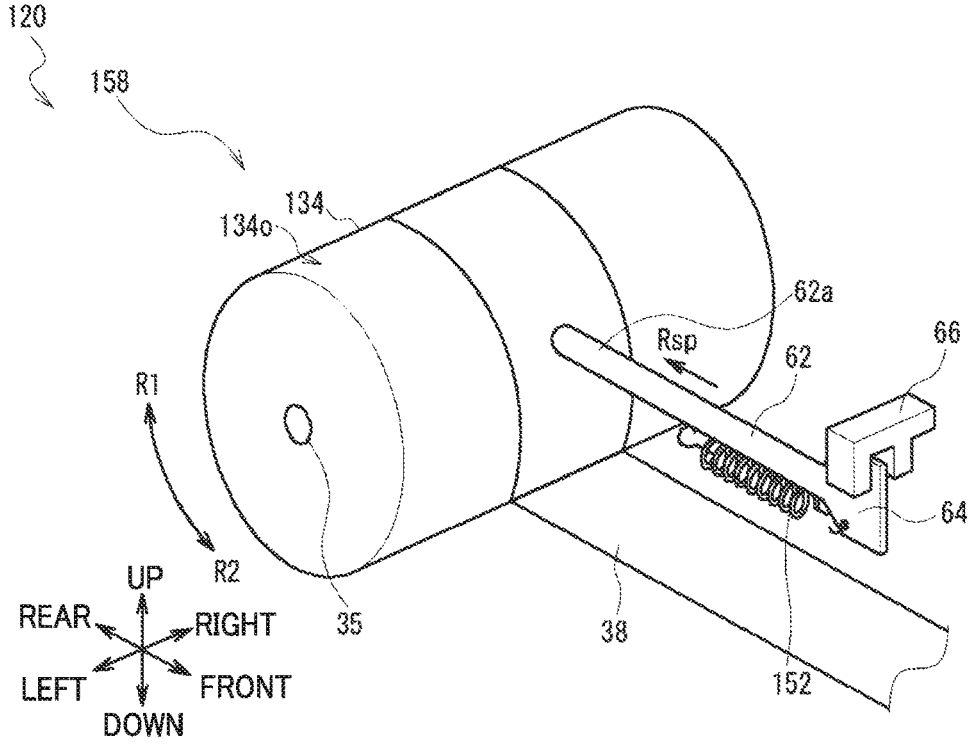
FIG. 17 is a perspective view illustrating configuration of a temporary retention section according to a second exemplary embodiment in a rotation-permitted state.
Figure 18:
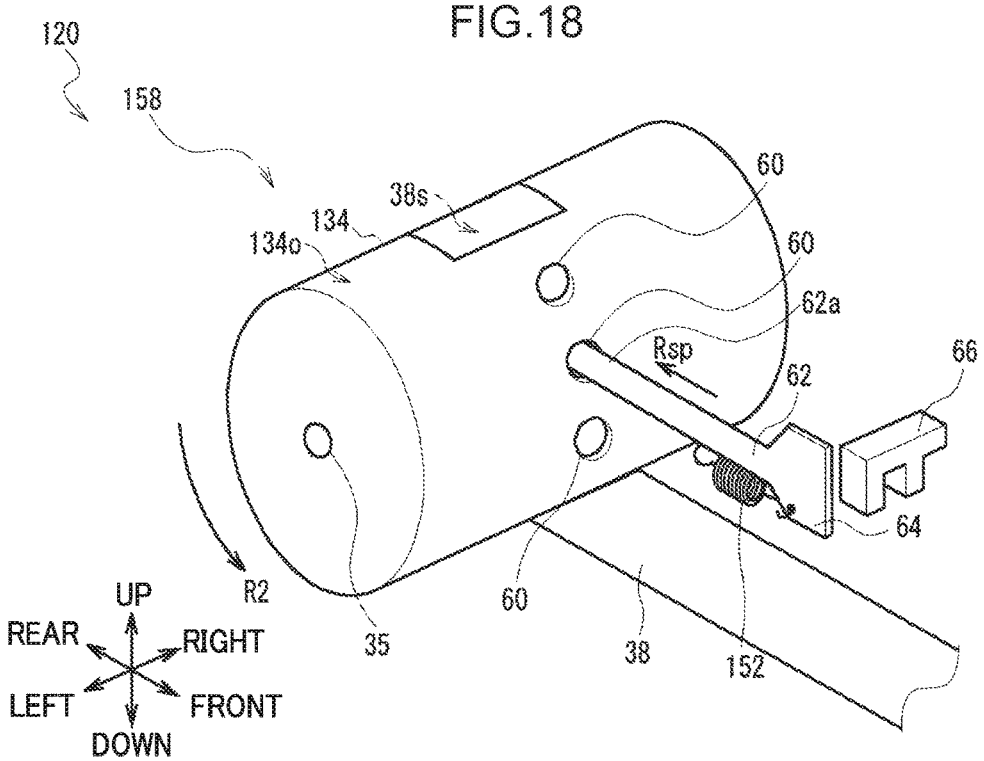
FIG. 18 is a perspective view illustrating configuration of the temporary retention section according to the second exemplary embodiment in a rotation-restricted state.

As illustrated in FIG. 17 and FIG. 18, the temporary retention section 120 has a similar configuration as the temporary retention section 20 of the first exemplary embodiment, except in that a reverse-winding prevention mechanism 158 differs from the reverse-winding prevention mechanism 58.

Circular holes 60, each having a diameter shorter than the tape width of the tape 38, are provided at a central portion of a drum circumferential face 134*o* of a drum 134, namely at a location around which the tape 38 is wound. Plural of the holes 60 are provided at a predetermined spacing over a predetermined angle range (for example 320°) from the vicinity of the take-up direction R1 side of the tape start end portion 38*s* toward the take-up direction R1. The holes 60 place the exterior and the interior of the drum 134 in communication with each other.

The tape 38 is wound around the outside of the holes 60, such that the holes 60 are not exposed to the exterior. The tape 38 is present between the holes 60 and a restriction shaft 62, thereby restricting movement of the restriction shaft 62 in a shaft approach direction Rsp, this being a direction in which the restriction shaft 62 enters the holes 60.

The restriction shaft 62 is provided at a front side of the drum 134. The restriction shaft 62 is a rod shaped member running along the front-rear direction, and is provided in front of the drum 134 so as to be capable of back-and-forth movement in a shaft retraction direction to separate and retract from the drum 134, and the shaft approach direction Rsp approaching the drum 134. A front end portion of the restriction shaft 62 is provided with a plate shaped shaft detector 64. The restriction shaft 62 is biased toward the shaft approach direction Rsp by a biasing member 152, serving as a biasing section configured by a tension spring fixed to the frame 30 (FIG. 3) at a rear end and anchored to the shaft detector 64 at a front end. The restriction shaft 62 has a circular column shape with an outer diameter that is slightly smaller than the inner diameter of the holes 60. An insertion portion 62*a* extending along the shaft retraction direction and the shaft approach direction Rsp direction is formed at a rear end portion of the restriction shaft 62.

A shaft detection sensor 66 is provided at a location facing the shaft detector 64 of the restriction shaft 62. The shaft detection sensor 66 is an optical sensor with an angular C shape, disposed with a light emitting portion and a light receiving portion on the left and right of a groove through which the shaft detector 64 passes. The shaft detection sensor 66 detects the presence of the shaft detector 64 by the light receiving portion detecting that light from the light emitting portion has been blocked by the shaft detector 64. The shaft detection sensor 66 thereby detects whether the restriction shaft 62 is in a retracted state retracted from the holes 60, or in an engaged state having entered one of the holes 60, and sends shaft detection results to the retention controller 32 as detection results.

In this configuration, when the drum 134 rotates in the unwind direction R2 and the tape start end portion 38*s* moves further toward the unwind direction R2 than a position overlapped by the tape 38, the tape 38 comes away from the holes 60, thereby exposing the holes 60. Accordingly, the tape 38 that has been previously restricting movement of the restriction shaft 62, serving as a restriction section, toward the shaft approach direction Rsp is no longer present at the outside of the holes 60. As illustrated in FIG. 18, the restriction shaft 62 moves toward the shaft approach direction Rsp and the insertion portion 62*a* enters one of the holes 60, serving as a stopper section, to adopt a shaft engaged state and stop rotation of the drum 134. When this occurs, the shaft detector 64 moves to a position away from the optical axis of the shaft detection sensor 66. Accordingly, the shaft detection sensor 66 detects an OFF state. The retention controller 32 stops rotation of the motor when notified of the OFF state by the shaft detection sensor 66.

In the case of the temporary retention section 20 (FIG. 6) of the first exemplary embodiment, since the tape 38 is pressed toward the groove 46 by the restriction lever 48, the tape 38 flexes toward the groove circumferential face 46*o* of the groove 46 when performing banknote storage operations and banknote discharge operations.

By contrast, in the temporary retention section 120, the tape 38 is wound around the outside of the holes 60 that are formed at discrete locations, rather than continuously, to the drum circumferential face 134*o* along the take-up direction R1 and the unwind direction R2. Accordingly, in the temporary retention section 120, the tape 38 is prevented from flexing toward the rotation shaft 35 through the holes 60 when performing banknote storage operations and banknote discharge operations, enabling the shape of the tape 38 to be maintained, and enabling the propensity for banknote jams to be reduced.

Moreover, the temporary retention section 120 also performs the possible reel revolutions computation operation and the tape length computation operation similarly to the temporary retention section 20, and also performs banknote storage operations and banknote discharge operations. The temporary retention section 120 of the second exemplary embodiment therefore also exhibits substantially the same operation and effects as the temporary retention section 20 according to the first exemplary embodiment.

3. Third Exemplary Embodiment

3-1. Configuration of Banknote Pay-in/Pay-Out Device

As illustrated in FIG. 1 and FIG. 2, a banknote pay-in/pay-out device 210 of an ATM 201 according to a third exemplary embodiment has a similar configuration as the banknote pay-in/pay-out device 10 of the ATM 1 of the first exemplary embodiment, except in that a temporary retention section 220 differs from the temporary retention section 20.

3-2. Configuration of Temporary Retention Section

Figure 19:
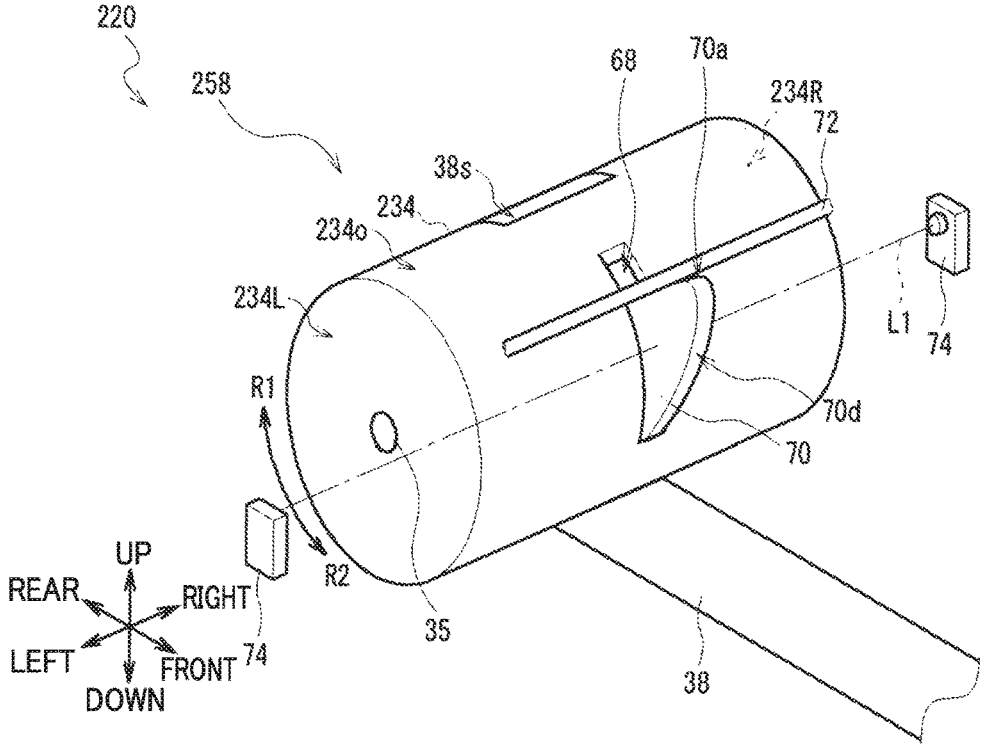
FIG. 19 is a perspective view illustrating configuration of the temporary retention section according to a third exemplary embodiment in a rotation-restricted state (1).
Figure 20:
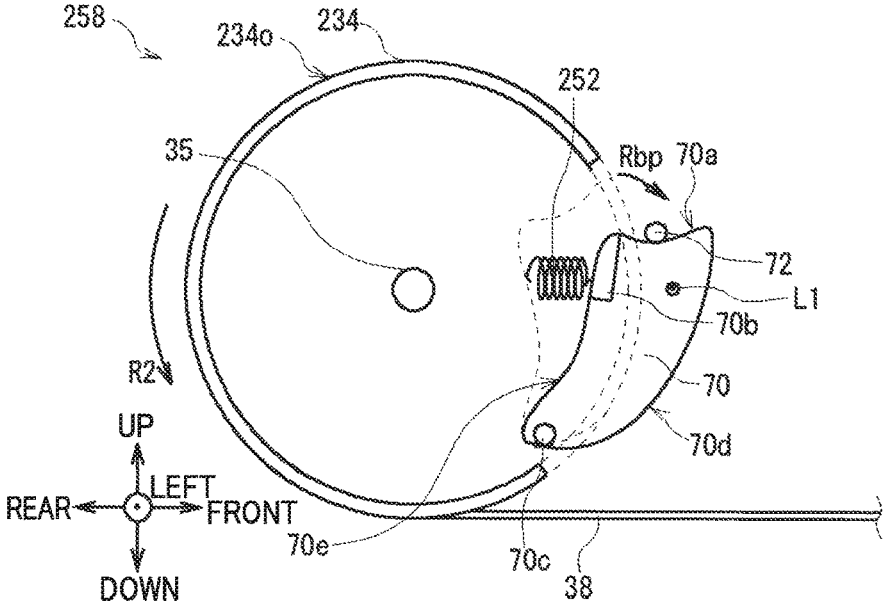
FIG. 20 is a side view from the left illustrating configuration of a temporary retention section according to the third exemplary embodiment in a rotation-restricted state (2).

As illustrated in FIG. 19 and FIG. 20, the temporary retention section 220 has a similar configuration as the temporary retention section 20 of the first exemplary embodiment, except in that a reverse-winding prevention mechanism 258 differs from the reverse-winding prevention mechanism 58. A drum left side plate 234L of a drum 234 is omitted from illustration in FIG. 20.

A hole 68 having a left-right direction width shorter than the tape width of the tape 38 is provided at a central portion of a drum circumferential face 234*o* of the drum 234, namely at a location around which the tape 38 is wound. The hole 68 is formed spanning from the vicinity of the take-up direction R1 side of the tape start end portion 38*s* along the take-up direction R1 over a predetermined angle range (for example 45°). The hole 68 places the exterior and the interior of the drum 234 in communication with each other. The drum 234 is formed with a drum left side plate 234L blocking the exterior off from the interior of the drum 234 at a left end portion, and a drum right side plate 234R blocking the exterior off from the interior of the drum 234 at a right end portion.

The tape 38 is wound around the outside of the hole 68 such that the hole 68 is not exposed to the exterior, and the tape 38 is present between a restriction plate 70 and a stopper shaft 72, thereby restricting the restriction plate 70 from pivoting in a restriction plate approach direction Rbp, this being direction in which the restriction plate 70 projects out to the exterior through the hole 68.

The restriction plate 70 is a plate shaped member with a slightly narrower width than the hole 68. An outside face 70*d*, this being an end face on the side toward the drum circumferential face 234*o*, is curved with a curvature equivalent to that of the drum circumferential face 234*o*. The restriction plate 70 is provided such that one end is capable of pivoting about a restriction plate pivot shaft 70*c* in a restriction plate retraction direction to separate and retract from the stopper shaft 72, and in a restriction plate approach direction to project out through the hole 68 to the exterior of the drum 234 and approach the stopper shaft 72. The restriction plate 70 is biased toward the restriction plate approach direction Rbp about the restriction plate pivot shaft 70*c* by a biasing member 252, serving as a biasing section, configured by a compression spring of which a rear end is fixed inside the drum 234 and a front end is anchored to an inside face 70*e* of the restriction plate 70 at a location away from the restriction plate pivot shaft 70*c*. The restriction plate 70 is stowed inside the drum 234 with the outside face 70*d* in substantially in the same plane as the drum circumferential face 234*o* in a state in which the restriction plate 70 is pressed down by the tape 38 so as to restrict pivoting toward the restriction plate approach direction Rbp, such that the restriction plate 70 functions as part of the drum circumferential face 234*o*. An abutting portion 70*a* that is curved toward the take-up direction R1 and that is abutted by the stopper shaft 72 is formed at a leading end side of the restriction plate 70 in the drum 234 unwind direction R2. A restriction plate stopper 70*b* projects out from the restriction plate 70 in the left-right direction in the vicinity of the location where the biasing member 252 is anchored to the inside face 70*e*. The restriction plate stopper 70*b* of the restriction plate 70 abuts both left and right sides of the hole 68 at an inner circumferential face of the drum 234, thereby stopping the pivoting toward the restriction plate approach direction Rbp when the restriction plate 70 pivots in the restriction plate approach direction Rbp such that the abutting portion 70*a* projects out to the exterior of the drum 234 through the hole 68.

The stopper shaft 72 is provided in front of the drum 234, and extends in the left-right direction on what is a rotation path of the restriction plate 70 when the restriction plate 70 is projecting out to the exterior of the drum 234 as the drum 234 rotates. A plate detection sensor 74 is provided in front of the drum 234 and at the left-right direction outsides of the drum 234. The plate detection sensor 74 is an optical sensor with a light emitting portion and a light receiving portion respectively disposed on the left and right such that a sensor optical axis L1 is positioned at a position where the sensor optical axis L1 will be blocked by the restriction plate 70 when the restriction plate 70 is projecting out to the exterior through the hole 68. The plate detection sensor 74 detects the presence of the restriction plate 70 by the light receiving portion detecting that light from the light emitting portion has been blocked by the restriction plate 70. The plate detection sensor 74 thereby detects whether the restriction plate 70 is in a retracted state retracted from the stopper shaft 72, or in an approaching state approaching the stopper shaft 72, and sends restriction plate detection results to the retention controller 32 as detection results.

In this configuration, when the drum 234 rotates in the unwind direction R2 and the tape start end portion 38*s* is exposed due to moving further in the unwind direction R2 than a position overlapped by the tape 38, the tape 38 comes away from the hole 68, thereby exposing the hole 68. Accordingly, the tape 38 that has been previously restricting movement of the restriction plate 70, serving as a restriction section, toward the restriction plate approach direction Rbp is no longer present at the outside of the restriction plate 70, and the restriction plate 70 pivots toward the restriction plate approach direction Rbp to adopt a restriction plate projecting state projecting out to the exterior of the drum circumferential face 234*o* through the hole 68. The abutting portion 70*a* strikes the stopper shaft 72, serving as a stopper section, thereby stopping rotation of the drum 234. When this occurs, the restriction plate 70 moves to a position blocking the optical axis of the plate detection sensor 74. The plate detection sensor 74 accordingly detects the ON state. The retention controller 32 stops rotation of the motor on being notified of the ON state by the plate detection sensor 74.

Moreover, the temporary retention section 220 also performs the possible reel revolutions computation operation and the tape length computation operation similarly to the temporary retention section 20, and also performs banknote storage operations and banknote discharge operations. The temporary retention section 220 of the third exemplary embodiment therefore also exhibits substantially the same operation and effects as the temporary retention section 20 according to the first exemplary embodiment.

4. Fourth Exemplary Embodiment

4-1. Configuration of Banknote Pay-in/Pay-Out Device

As illustrated in FIG. 1 and FIG. 2, a banknote pay-in/pay-out device 310 of an ATM 301 according to a fourth exemplary embodiment has a similar configuration as the banknote pay-in/pay-out device 210 of the ATM 201 of the third exemplary embodiment, except in that a temporary retention section 320 differs from the temporary retention section 220.

4-2. Configuration of Temporary Retention Section

Figure 21:
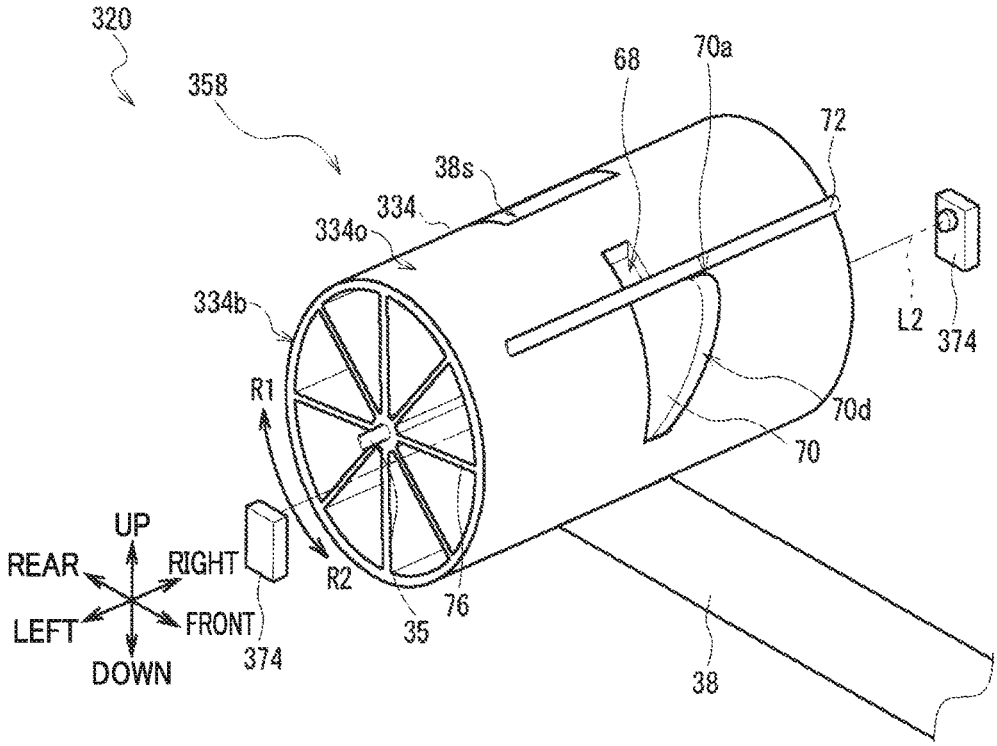
FIG. 21 is a perspective view illustrating configuration of a temporary retention section according to a fourth exemplary embodiment in a rotation-restricted state (1).
Figure 22:
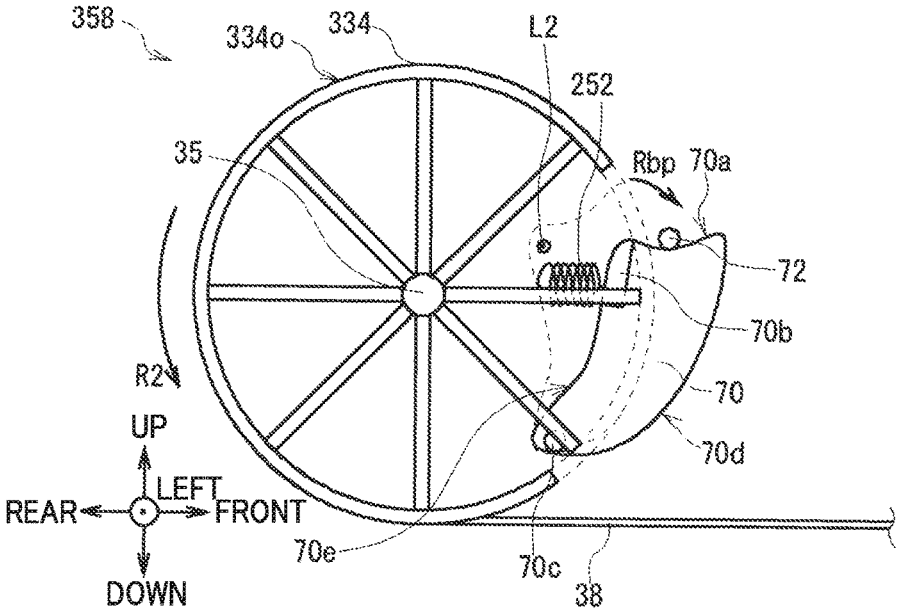
FIG. 22 is a side view from the left illustrating configuration of the temporary retention section according to the fourth exemplary embodiment in a rotation-restricted state (2).

As illustrated in FIG. 21 and FIG. 22, the temporary retention section 320 has a similar configuration as the temporary retention section 220 of the third exemplary embodiment, except in that a reverse-winding prevention mechanism 358 differs from the reverse-winding prevention mechanism 258.

A drum 334 differs from the drum 234 in that the drum left side plate 234L and the drum right side plate 234R are omitted, and eight flat plate shaped internal drum spokes 76 spaced at intervals of 45° to each other about the rotation shaft 35 are connected to a drum outer circumferential plate 334*b*. The drum 334 is thereby formed with linear voids penetrating from the right outside to the left outside of the drum 334, while maintaining the necessary strength.

A plate detection sensor 374 differs from the plate detection sensor 74 in that a sensor optical axis L2 is provided on a rotation path of the restriction plate 70 when the restriction plate 70 is in the retracted state at a position passing across the interior of the drum 334. The sensor optical axis L2 of the plate detection sensor 374 is blocked off by the restriction plate 70 for a predetermined duration with each revolution of the drum 334. Accordingly, the plate detection sensor 374 repeatedly detects an OFF state, followed by detecting an ON state for a predetermined duration that is shorter than that of the OFF state, accompanying rotation of the drum 334.

In this configuration, when the drum 334 rotates in the unwind direction R2 and the tape start end portion 38*s* is exposed due to moving further in the unwind direction R2 than a position overlapped by the tape 38, the tape 38 comes away from the hole 68, thereby exposing the hole 68. Accordingly, the tape 38 that has been previously restricting movement of the restriction plate 70, serving as a restriction section, toward the restriction plate approach direction Rbp is no longer present at the outside of the restriction plate 70, and the restriction plate 70 pivots toward the restriction plate approach direction Rbp to adopt a restriction plate projecting state projecting out to the exterior of a drum circumferential face 334*o* through the hole 68. The abutting portion 70*a* strikes the stopper shaft 72, serving as a stopper section, thereby stopping rotation of the drum 334. When this occurs, the restriction plate 70 moves to a position away from the optical axis of the plate detection sensor 374. The plate detection sensor 374 accordingly detects the OFF state. The retention controller 32 stops rotation of the motor on being notified of the OFF state by the plate detection sensor 374 continuously over a duration equal to or greater than a duration corresponding to a single revolution of the drum 234.

Moreover, the temporary retention section 320 also performs the possible reel revolutions computation operation and the tape length computation operation similarly to the temporary retention section 20, and also performs banknote storage operations and banknote discharge operations. The temporary retention section 320 of the fourth exemplary embodiment therefore also exhibits substantially the same operation and effects as the temporary retention section 220 according to the third exemplary embodiment.

5. Fifth Exemplary Embodiment

5-1. Configuration of Banknote Pay-in/Pay-Out Device

As illustrated in FIG. 1 and FIG. 2, a banknote pay-in/pay-out device 410 of an ATM 401 according to a fifth exemplary embodiment has a similar configuration as the banknote pay-in/pay-out device 310 of the ATM 301 of the fourth exemplary embodiment, except in that a temporary retention section 420 differs from the temporary retention section 320.

5-2. Configuration of Temporary Retention Section

Figure 23:
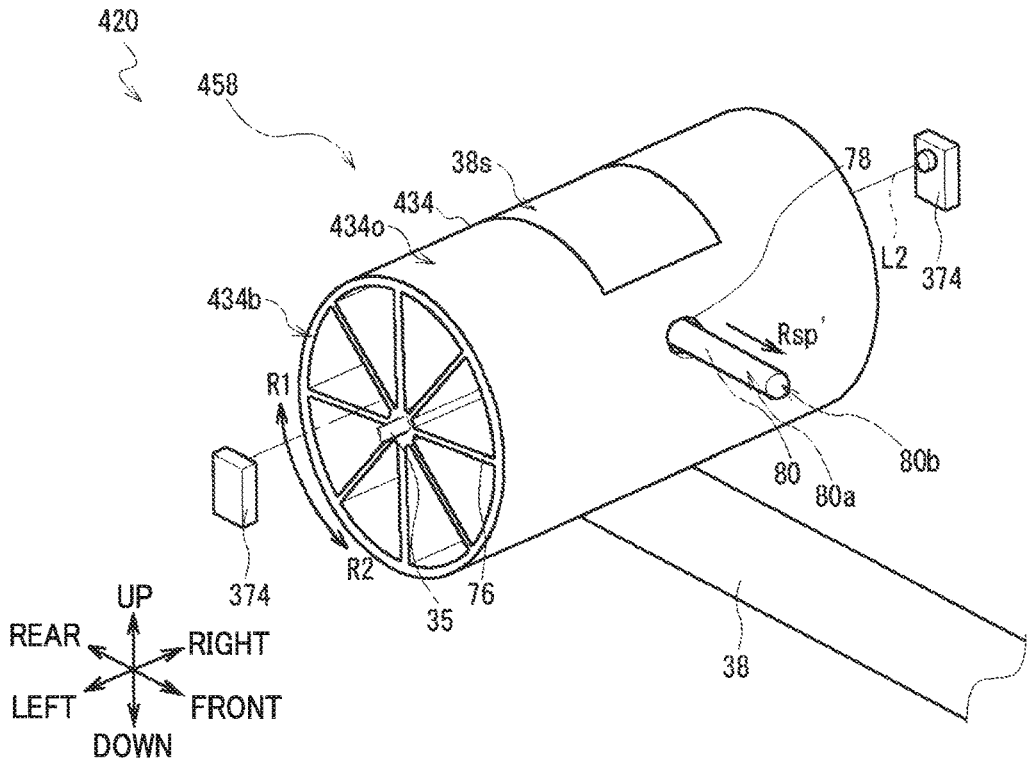
FIG. 23 is a perspective view illustrating configuration of a temporary retention section according to a fifth exemplary embodiment in a rotation-restricted state (1).
Figure 24:
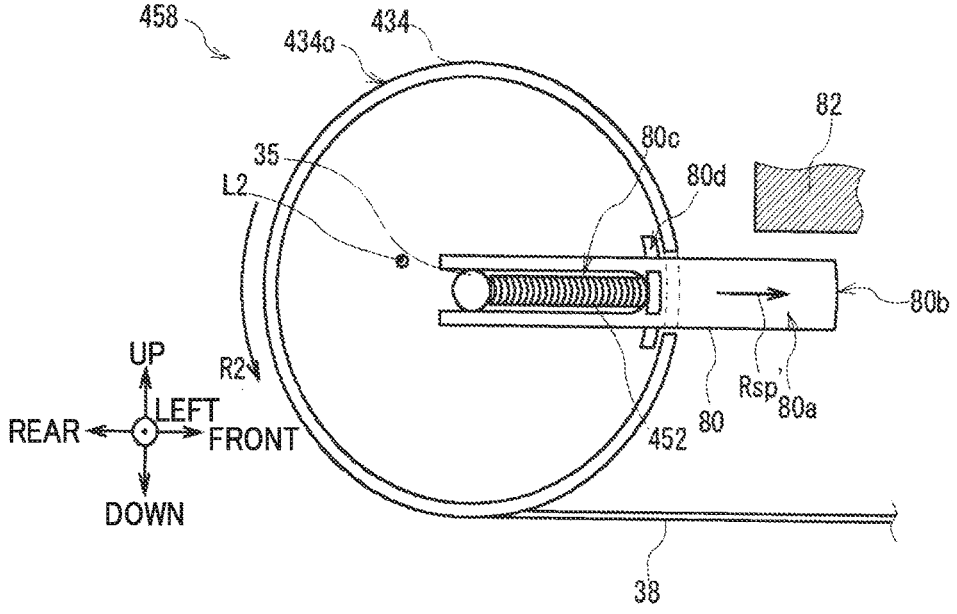
FIG. 24 is a side view from the left illustrating configuration of the temporary retention section according to the fifth exemplary embodiment in a rotation-restricted state (2).

As illustrated in FIG. 23 and FIG. 24, the temporary retention section 420 has a similar configuration as the temporary retention section 320 of the third exemplary embodiment, except in that a reverse-winding prevention mechanism 458 differs from the reverse-winding prevention mechanism 358. The internal drum spokes 76 are omitted from illustration in FIG. 24.

A drum 434 is provided with eight of the internal drum spokes 76, similarly to the drum 334. The plate detection sensor 374 is provided at a position where the sensor optical axis L2 passes through the inside of the drum 434, and is blocked when a restriction shaft 80 is in a retracted state.

A circular hole 78 having a diameter shorter than the tape width of the tape 38 is provided at a central portion of a drum circumferential face 434*o* of the drum 434, namely at a location around which the tape 38 is wound. The single hole 78 is provided in the vicinity of the take-up direction R1 side of the tape start end portion 38*s*, and places the exterior and the interior of the drum 434 in communication with each other.

The tape 38 is wound around the outside of the hole 78, such that the hole 78 is not exposed to the exterior. The tape 38 is present between the restriction shaft 80 and a frame stopper 82, thereby restricting movement of the restriction shaft 80 in a shaft approach direction Rsp', this being a direction in which the restriction shaft 80 projects out to the exterior through the hole 78.

The restriction shaft 80 is provided inside the drum 434. The restriction shaft 80 is a rod shaped strip metal member provided running along the radial direction of the drum 434 so as to be capable of back-and-forth movement in a shaft retraction direction to separate and retract from the frame stopper 82, and the shaft approach direction Rsp' to project out through the hole 78 to the exterior of the drum 434 and approach the frame stopper 82. A projecting portion 80*a* with a circular column shape having an outer diameter slightly smaller than the inner diameter of the hole 78 is formed extending along the shaft retraction direction and the shaft approach direction Rsp' at a front end portion of the restriction shaft 80. An outside face 80*b*, this being an end face of the projecting portion 80*a* on the side toward the drum circumferential face 434*o*, is curved with a curvature equivalent to that of the drum circumferential face 434*o*. The restriction shaft 80 functions as part of the drum circumferential face 434*o* due to being stowed inside the drum 434 with the outside face 80*b* in substantially the same plane as the drum circumferential face 434*o* when in a state in which the restriction shaft 80 is pressed down by the tape 38, restricting movement toward the shaft approach direction Rsp'. A biasing member housing section 80*c* inside which a biasing member 452 is housed is formed at a rear end portion of the restriction shaft 80. The restriction shaft 80 is biased toward the shaft approach direction Rsp' due to housing the biasing member 452, serving as a biasing section configured by a compression spring fixed to the rotation shaft 35 at a rear end, inside the biasing member housing section 80*c*. A restriction shaft stopper 80*d* projects out so as to conform to an inner circumferential face of a drum outer circumferential plate 434*b* from the vicinity of a front end of the biasing member housing section 80*c* of the restriction shaft 80. The restriction shaft stopper 80*d* abuts the vicinity of the hole 78 at an inner circumferential face of the drum outer circumferential plate 434*b*, thereby stopping movement of the restriction shaft 80 in the shaft approach direction Rsp', when the restriction shaft 80 moves in the shaft approach direction Rsp' such that the restriction shaft 80 projects out through the hole 78 to the exterior of the drum 434.

The frame stopper 82, configuring part of the frame 30, is provided in front of the drum 434 on what is a rotation path of the projecting portion 80*a* of the restriction shaft 80 when the projecting portion 80*a* of the restriction shaft 80 is projecting out through the hole 78 as the drum 434 rotates. The plate detection sensor 374 is disposed such that the sensor optical axis L2 is positioned at a position that is away from the restriction shaft 80 when the restriction shaft 80 is projecting out to the exterior through the hole 78.

In this configuration, when the drum 434 rotates in the unwind direction R2 and the tape start end portion 38*s* is exposed due to moving further in the unwind direction R2 than a position overlapped by the tape 38, the tape 38 comes away from the hole 78, thereby exposing the hole 78. Accordingly, the tape 38 that has been previously restricting movement of the restriction shaft 80, serving as a restriction section, toward the shaft approach direction Rsp' is no longer present, and the restriction shaft 80 moves toward the shaft approach direction Rsp' and projects out to the exterior of the drum circumferential face 434*o* through the hole 78 to adopt a shaft projecting state, and the projecting portion 80*a* strikes the frame stopper 82, serving as a stopper section, thereby stopping rotation of the drum 434. When this occurs, the restriction shaft 80 moves to a position away from the sensor optical axis L2 of the plate detection sensor 374. The plate detection sensor 374 accordingly detects the OFF state. The retention controller 32 stops rotation of the motor on being notified of the OFF state by the plate detection sensor 374.

Moreover, the temporary retention section 420 also performs the possible reel revolutions computation operation and the tape length computation operation similarly to the temporary retention section 20, and also performs banknote storage operations and banknote discharge operations. The temporary retention section 420 of the fifth exemplary embodiment therefore also exhibits substantially the same operation and effects as the temporary retention section 320 according to the fourth exemplary embodiment.

6. Sixth Exemplary Embodiment

6-1. Configuration of Banknote Pay-in/Pay-Out Device

As illustrated in FIG. 1 and FIG. 2, a banknote pay-in/pay-out device 510 of an ATM 501 according to a sixth exemplary embodiment has a similar configuration as the banknote pay-in/pay-out device 10 of the ATM 1 of the first exemplary embodiment, except in that a temporary retention section 520 differs from the temporary retention section 20.

6-2. Configuration of Temporary Retention Section

Figure 25:
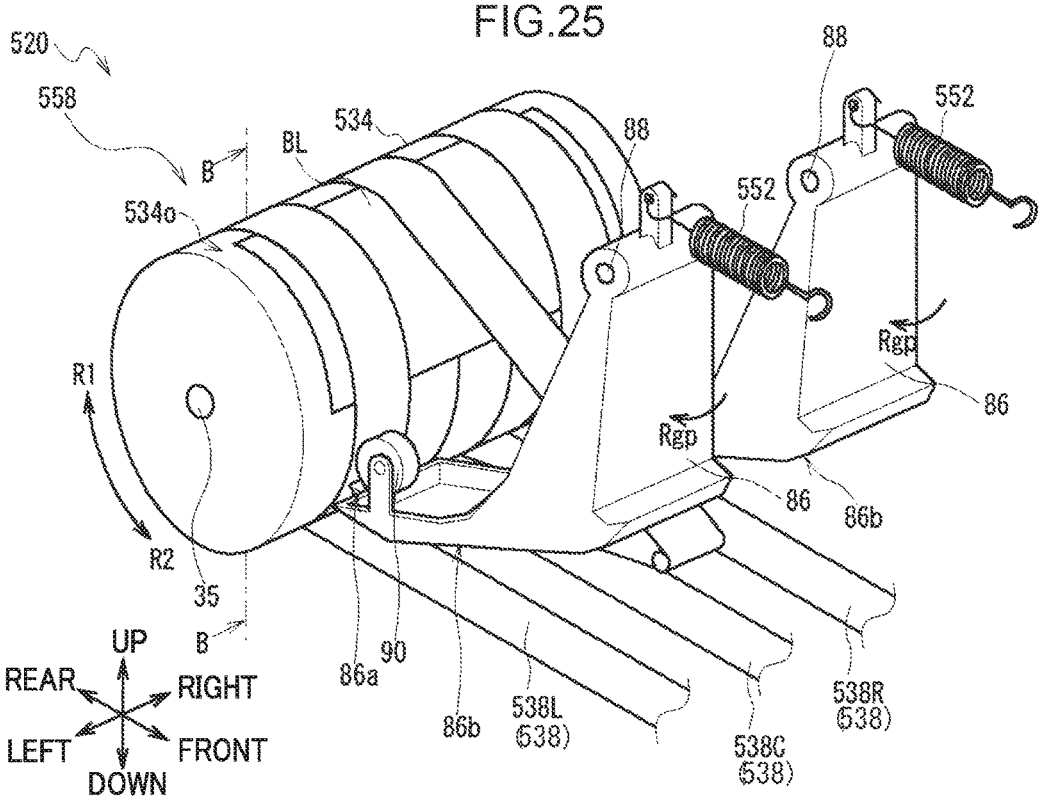
FIG. 25 is a perspective view illustrating configuration of a temporary retention section according to a sixth exemplary embodiment in a rotation-permitted state.
Figure 26:
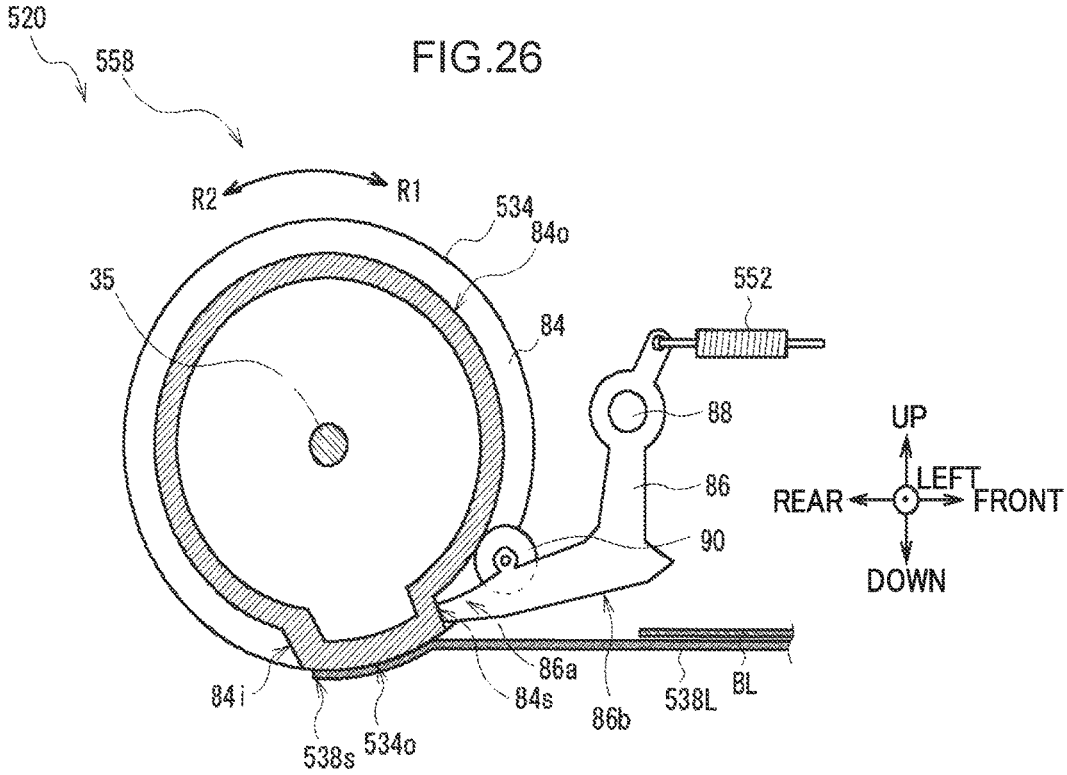
FIG. 26 is a cross-section taken along the direction indicated by the arrows B-B in FIG. 25, illustrating configuration of the temporary retention section according to the sixth exemplary embodiment in a rotation-restricted state.

As illustrated in FIG. 25 and FIG. 26, the temporary retention section 520 has a similar configuration as the temporary retention section 20 of the first exemplary embodiment, except in that a reverse-winding prevention mechanism 558 differs from the reverse-winding prevention mechanism 58.

Three tapes 538L, 538C, and 538R (referred to below collectively as the tapes 538) are wound onto a drum 534 alongside each other in the left-right direction. The tape 538C positioned at the center is wound around the drum 534 approximately once more than the tapes 538L and 538R, and is led out toward the front from the front side of a drum circumferential face 534*o* by a shaft, such that banknotes BL are guided at an upper face when being wrapped onto or fed out from the drum 534. Grooves 84, each having a narrower width than the tape width of the respective tapes 538L and 538R are formed in the drum 534 in the vicinity of left and right end portions of the outer circumference of the drum 534, namely at locations around which the tapes 538L and 538R are wound. The grooves 84 have a similar configuration as the groove 46 of the first exemplary embodiment.

The tapes 538L and 538R are wound around the outside of the grooves 84 such that the grooves 84 are not exposed to the exterior. The tapes 538L and 538R are present between the grooves 84 and restricting guides 86, thereby restricting the restricting guides 86, serving as guide mechanisms, from pivoting toward a guide approach direction Rgp, this being a pivot direction in which the restricting guides 86 enter the grooves 84.

The restricting guides 86 are L-shaped members that extend from top to bottom at a front side, and hook around toward the rear side toward the drum 534 at a lower end portion. Each restricting guide 86 is formed with a guide face 86*b* at a lower end face to guide the upper faces of banknotes BL. The guide faces 86*b* respectively face upper faces of the tapes 538L and 538R, and are provided at the upper face side of the banknotes, this being the face on the opposite side of the banknotes to the tapes 538L and 538R, so as to guide the faces of the banknotes as the banknotes are being fed out from the drum 534. The restricting guides 86 are each provided so as to be capable of pivoting about a guide pivot shaft 88 at the front of the drum 534 in a guide retraction direction to separate and retract from the grooves 84, or in the guide approach direction Rgp approaching the grooves 84. The restricting guides 86 are, moreover, each biased toward the guide approach direction Rgp about the guide pivot shaft 88 by anchoring an upper side of the guide pivot shaft 88 to a rear end of a biasing member 552, serving as a biasing section configured by a tension spring of which a front end is fixed to the frame 30 (FIG. 3). An abutting portion 86*a* that abuts a stopper face 84*s* of the corresponding groove 84 is formed at a lower end portion of each restricting guide 86. Moreover, each restricting guide 86 is provided with an abutting roller 90 that is capable of rotating so as to roll while abutting the outer circumferential face of the corresponding tape 538L or 538R when in a rotation-permitted state, and so as to roll in contact with a groove circumferential face 84*o* of the corresponding groove 84 when the abutting portion 86*a* is in a guide engaged state inside the groove 84.

The abutting rollers 90 rotate while abutting the outer circumferential faces of the tapes 538L and 538R such that the restricting guides 86 pivot accompanying changes in the number of banknotes BL stored on the drum 534, namely accompanying changes in the apparent outer diameter of the drum 534, and are always in a state moved toward the drum 534.

In this configuration, when the drum 534 rotates toward the unwind direction R2 and tape start end portions 538*s* are exposed due to moving further in the unwind direction R2 than positions overlapped by the tapes 538L and 538R, the tapes 538 come away from the grooves 84, thereby exposing the grooves 84. The tapes 538, which have been previously restricting the restricting guides 86, serving as restriction sections, from pivoting toward the guide approach direction Rgp, are therefore no longer present at the outside of the grooves 84, and so the restricting guides 86 pivot toward the guide approach direction Rgp. As illustrated in FIG. 26, the abutting portions 86*a* and the abutting rollers 90 roll against sloping portions 84*i* and enter the grooves 84, serving as stopper sections, thereby adopting the guide engaged state. When this occurs, the restricting guides 86 pivot about the guide pivot shafts 88 to a position away from the optical axis of a guide detection sensor. The guide detection sensor accordingly detects on OFF state.

When the retention controller 32 is notified of the OFF state by the guide detection sensor, the retention controller 32 stops rotation of the motor. When the motor is stopped under the control of the retention controller 32, the drum 534 comes to a stop after continuing to rotate for a time. In a case in which a technician, for example, manually rotates the drum 534 in the unwind direction R2 from this state, the stopper faces 84*s* of the grooves 84 of the drum 534 would abut the abutting portions 86*a* of the restricting guides 86. The abutting portions 86*a* are biased toward the groove circumferential faces 84*o* and the stopper faces 84*s* by the biasing members 552, and continue to abut the stopper faces 84*s* without the restricting guides 86 coming out of the grooves 84, even if the restricting guides 86 are applied with force in the unwind direction R2 direction from the drum 534. Rotation of the drum 534 in the unwind direction R2 accordingly continues to be restricted.

Figure 27:
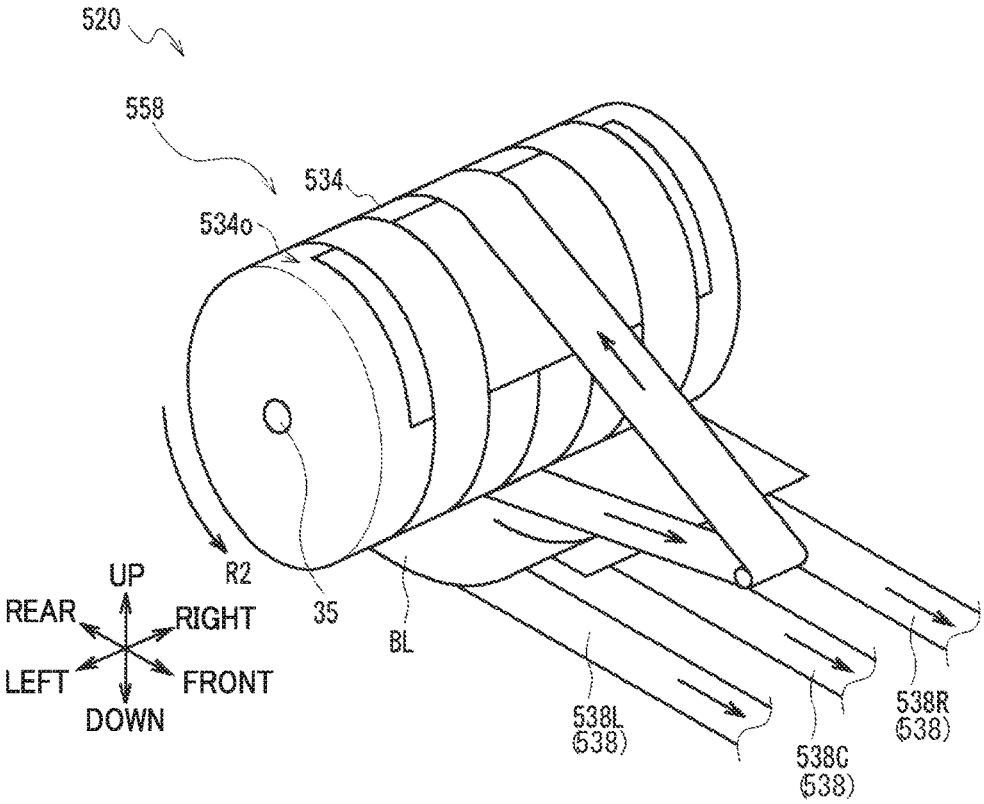
FIG. 27 is a perspective view illustrating curling of a banknote.

As illustrated in FIG. 27, supposing a tearing of a banknote BL has occurred in a case in which the restricting guides 86 are not present, the banknote BL may curl upward, where the tapes 538L and 538R are not present in front of the drum 534, at the left-right direction outside of the torn location, potentially leading to a banknote jam.

By contrast, the temporary retention section 520 is provided with the restricting guides 86 in front of the drum 534. The restricting guides 86 guide the upper faces of banknotes BL in front of the drum 534, and also stop rotation of the drum 534. This thereby enables banknotes to be suppressed from curling upward, and also enables reverse-winding to be prevented.

Moreover, the temporary retention section 520 also performs the possible reel revolutions computation operation and the tape length computation operation similarly to the temporary retention section 20, and also performs banknote storage operations and banknote discharge operations. The temporary retention section 520 of the sixth exemplary embodiment therefore also exhibits substantially the same operation and effects as the temporary retention section 320 according to the fourth exemplary embodiment.

7. Other Exemplary Embodiments

Figure 28:
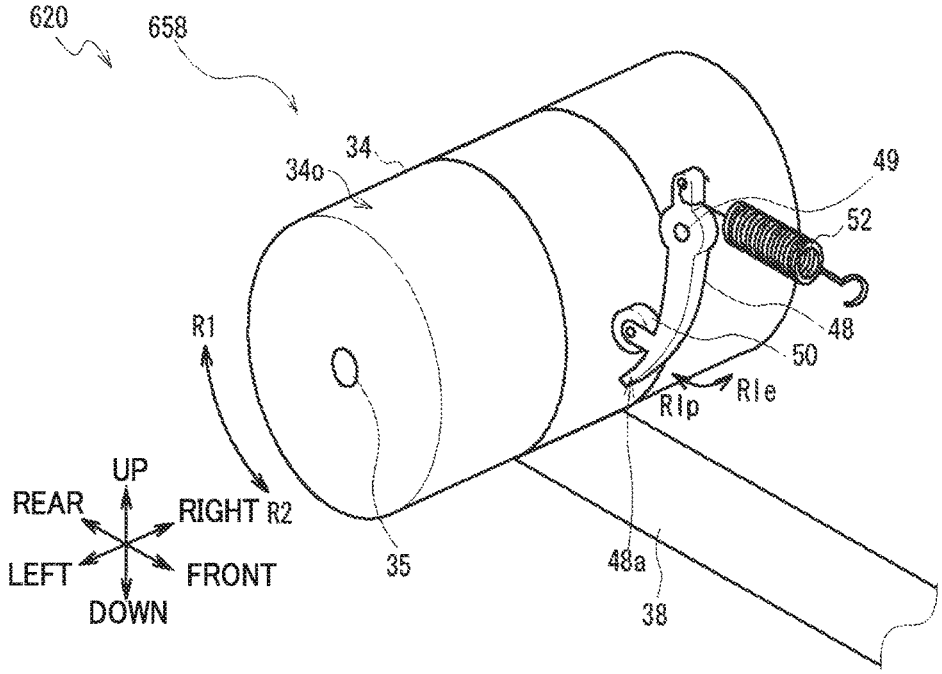
FIG. 28 is a perspective view illustrating configuration of a temporary retention section according to another exemplary embodiment (1).

In the first exemplary embodiment described above, explanation has been given regarding a case in which the lever detection sensor 56 detects the lever detected portion 54 of the restriction lever 48. The exemplary embodiment is not limited thereto, and the lever detection sensor 56 and the lever detected portion 54 may be omitted from the reverse-winding prevention mechanism 58, as in a reverse-winding prevention mechanism 658 of a temporary retention section 620 illustrated in FIG. 28. Moreover, the shaft detection sensor 66 and the shaft detector 64 may be omitted from the reverse-winding prevention mechanism 158 according to the second exemplary embodiment (FIG. 17 and FIG. 18), the plate detection sensor 74 may be omitted from the reverse-winding prevention mechanism 258 according to the third exemplary embodiment (see FIG. 19 and FIG. 20), the plate detection sensor 374 may be omitted from the reverse-winding prevention mechanism 358 according to the fourth exemplary embodiment (FIG. 21 and FIG. 22), and the plate detection sensor 374 may be omitted from the reverse-winding prevention mechanism 458 according to the fifth exemplary embodiment (FIG. 23 and FIG. 24).

In the first exemplary embodiment described above, explanation has been given regarding a case in which the groove 46 is carved out over a predetermined angle range of 320° from the sloping face 46*i* along the take-up direction R1. The exemplary embodiment is not limited thereto, and grooves may be carved out over various angle ranges from the sloping face 46*i* along the take-up direction R1. In such cases, as long as the groove has a sufficient length for the drum 34 to come to a stop before the stopper face 46*s* contacts the abutting portion 48*a* of the restriction lever 48, the abutting portion 48*a* of the restriction lever 48 may be prevented from striking the stopper face 46*s* of the groove 46 suddenly and causing the rotation of the drum 34 to come to an abrupt stop.

Moreover, in the first exemplary embodiment described above, explanation has been given regarding a case in which the abutting roller 50 rolls while in contact with the tape 38, and the abutting portion 48*a* does not abut the tape 38. The exemplary embodiment is not limited thereto, and, particularly in cases in which the rotation speed of the drum 34 is low, the abutting roller 50 may be omitted and the drum 34 may be rotated with the abutting portion 48*a* in contact with the tape 38.

Moreover, in the second exemplary embodiment described above, explanation has been given regarding a case in which rotation of the drum 134 is stopped by inserting the circular column shaped insertion portion 62*a* into the circular holes 60. The exemplary embodiment is not limited thereto, and insertion sections of various shapes may be inserted into holes of various shapes that allow insertion of the insertion sections. For example, rotation of the drum 134 may be stopped by inserting a circular column shaped insertion section into a square hole, or by inserting an elliptical insertion section into an elliptical hole. Moreover, the holes 60 need not place the exterior and the interior of the drum 134 in communication with each other, and may be depressions into which the insertion portion 62*a* is inserted, and that abut the insertion portion 62*a*. Moreover, in the second exemplary embodiment described above, explanation has been given regarding a case in which plural of the holes 60 are provided in the drum 134. However, the exemplary embodiment is not limited thereto, and configuration may be made in which a single hole 60 is provided in the drum 134.

In the sixth exemplary embodiment described above, explanation has been given regarding a case in which the grooves 84 and the restricting guides 86 are provided corresponding to both tapes 538L and 538R. The exemplary embodiment is not limited thereto, and configuration may be made in which a groove 84 and a restricting guide 86 are provided to only one of the tapes 538L or 538R.

Moreover, in the first exemplary embodiment described above, explanation has been given regarding a case in which reverse-winding of the drum 34 is prevented by the restriction lever 48 abutting the stopper face 46*s* of the groove 46 formed in the drum 34. The exemplary embodiment is not limited thereto, and reverse-winding of the drum 34 may be prevented by the restriction lever 48 physically abutting various mechanisms synchronized with the drum 34, for example, so as to rotate in the same rotation direction as the drum 34.

Figure 29:
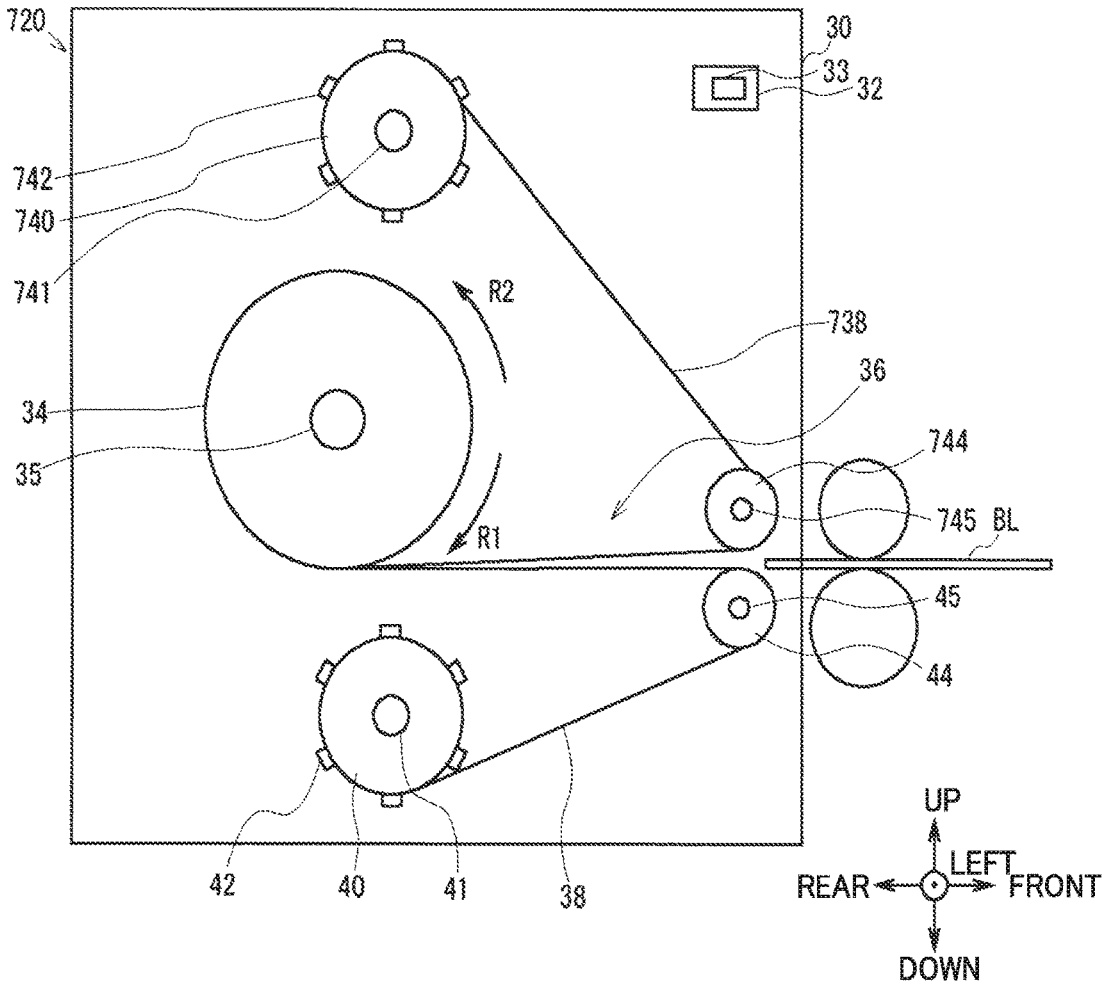
FIG. 29 is a side view from the left illustrating configuration of a temporary retention section according to another exemplary embodiment (2).
Figure 30:
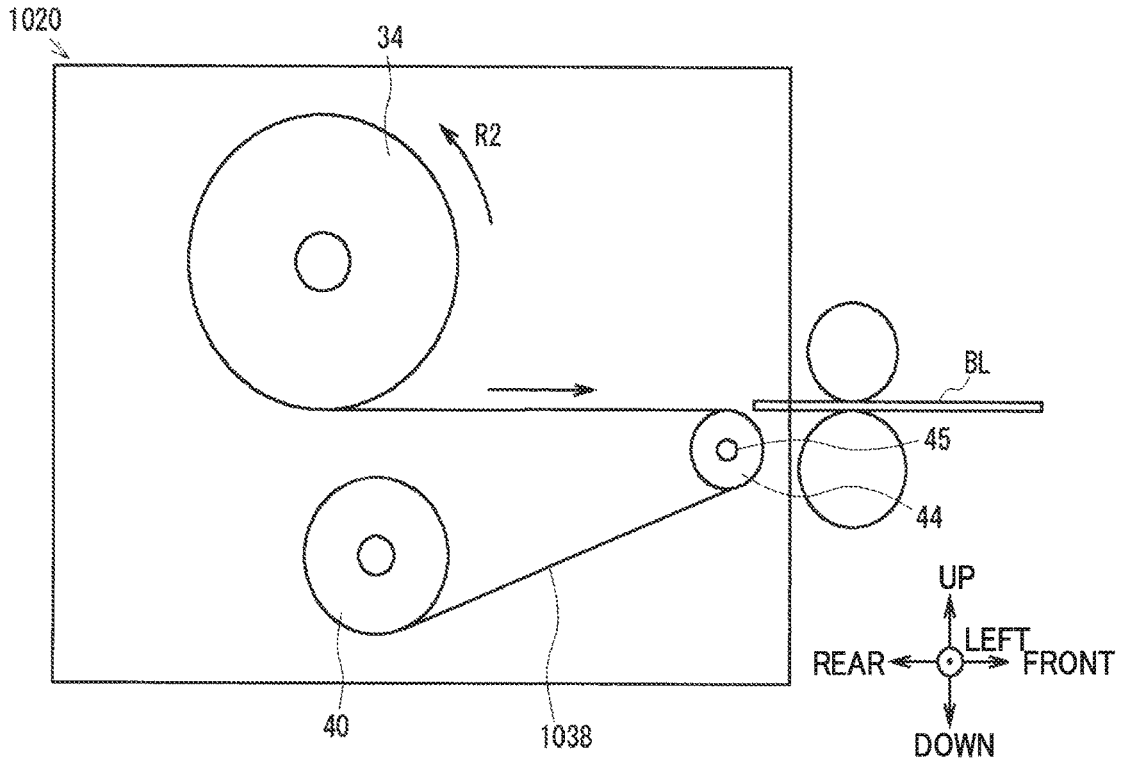
FIG. 30 is a side view from the left illustrating configuration of a conventional temporary retention section (1).

In the first exemplary embodiment described above, explanation has been given regarding a case in which the single tape 38 is wrapped onto the drum 34. However, the exemplary embodiment is not limited thereto, and configuration may be made with a temporary retention section 720, as illustrated in FIG. 29.

In the temporary retention section 720, a reel 740, serving as a second reel, is configured in a circular cylinder spool shape, similarly to the reel 40. The reel 740 is provided above the reel 40, namely at the upper side of the drum 34, so as to be capable of rotating about a rotation shaft 741 running parallel to the rotation shaft 35 of the drum 34. One end of a tape 738, serving as a second tape, is fixed to a circumferential face of the reel 740, and the tape 738 is wound onto the reel 740. The winding direction of the tape 738 onto the reel 740 is the opposite direction to the winding direction of the tape 38 onto the reel 40. Similarly to the reel 40, the reel 740 is biased toward a direction to take up the tape 738 by a torque limiter, not illustrated in the drawings, such that the tape 738 is constantly applied with a predetermined tension. Plate shaped reel rotation detected portions 742 project out from the circumferential face at a right end portion of the reel 740 at a predetermined spacing to form a radiating pattern.

A pulley 744 is provided in front of the reel 740 and above the pulley 44. The pulley 744 is formed in a circular cylinder shape, similarly to the pulley 44, and is inserted onto a shaft 745 running parallel to the rotation shaft 35 of the drum 34. The pulley 44 is capable of rotating about the shaft 745. The other end of the tape 738 wound onto the reel 740 is pulled out forward and downward from the reel 740, is pulled around the pulley 744 to turn back on itself toward the rear, and is fixed to the circumferential face of the drum 34 at the same position as the tape start end portion 38*s* of the tape 38.

In the temporary retention section 720 configured in this manner, when the drum 34 is rotated in the take-up direction R1, the tape 738 and the tape 38 are wrapped onto the circumferential face so as to form layers. When this is performed, the temporary retention section 720 sandwiches banknotes BL between the tape 738 and the tape 38, and wraps the banknotes BL onto the circumferential face of the drum 34 together with the tape 738 and the tape 38.

In this manner, in the temporary retention section 720, the banknotes BL are wrapped onto the circumferential face of the drum 34 by driving two tapes (the tape 38 and the tape 738). The abutting roller 50 of the restriction lever 48 abuts the outer peripheral face of the tape 38 wrapped onto the outside of the tape 738 with the banknotes BL therebetween.

In such cases, the temporary retention section 720 stops rotation of the drum 34 when the tape terminal end portion of at least one out of the tape 38 wound onto the reel 40 or the tape 738 wound onto the reel 740 has been reached. Moreover, the tape 38 and the tape 738 may be formed with different lengths, and rotation of the drum 34 may be stopped when the tape terminal end portion of the tape that is formed shorter has been reached.

Moreover, in the first exemplary embodiment described above, explanation has been given regarding a case in which the single tape drive system 36 is provided to the temporary retention section 20, namely, a case in which the single tape 38 is wound onto a left-right direction central portion of the drum 34. However, the exemplary embodiment is not limited thereto, and the number of corresponding pulleys may be increased and two or three tape drive systems may be provided, such that plural tapes are wound on alongside each other in the left-right direction, imparting greater stability to the banknotes BL wrapped onto the drum 34.

In such cases, it is sufficient that rotation of the drum 34 be stopped when the tape terminal end portion of at least one of the tapes wound around the plural pulleys has been reached, and that rotation of the drum 34 be stopped when the tape start end portion of at least one of the out of the plural tapes wound onto the drum 34 has been reached. Moreover, the plural tapes may be formed with different lengths to each other, and rotation of the drum 34 may be stopped when the tape start end portion or the tape terminal end portion of the tape that is formed with the shortest length has been reached. Moreover, it is sufficient that a groove and a restriction lever be provided to at least one out of plural tapes wound onto the drum 34. The same applies in the second to the fifth exemplary embodiments.

Moreover, in the first exemplary embodiment described above, explanation has been given regarding a case in which, for example, the initial reference state is configured by a state in which three meters of the tape 38, for example, has been wound onto the drum 34. The exemplary embodiment is not limited thereto, and various methods may be used to set the initial reference state. In the first exemplary embodiment, the initial reference state may be set based on the engaged state in order to enable detection of the engaged state by the action of the reverse-winding prevention mechanism 58.

Moreover, in the exemplary embodiments described above, explanation has been given regarding a case in which changes in the tape length are determined by detecting changes in the reel rotation angle Ra during the tape length computation operation. The exemplary embodiments are not limited thereto, and θ0' may be detected again as the rotation angle of the drum 34 when the reel 40 has been rotated by a reel rotation angle Ra θ2 in a banknote storage operation, and the length of the tape 38 may be determined to have changed in comparison to when the initial position finding operation has been performed in cases in which θ0' has changed by a predetermined amount or greater in comparison to θ0. In such cases, the retention controller 32 determines that the tape length has become longer when the θ0' has increased by the predetermined amount or greater in comparison to the θ0, and determines that the tape length has become shorter when the θ0' has decreased by the predetermined amount or greater in comparison to the θ0.

Moreover, in the exemplary embodiments described above, explanation has been given regarding a case in which θ2, stored when the initial position finding operation has been performed, is stored in the retention storage section 33 when performing the tape length computation operation, and the θ2 is later compared against the θ2'. The exemplary embodiments are not limited thereto, and the stored θ2 may be compared against the θ2' at various timings.

Moreover, in the exemplary embodiments described above, explanation has been given regarding a case in which in the tape length computation operation, the retention controller 32 sends a warning to the banknote controller 12 prompting replacement of the tape 38 when the tape 38 has become shorter. The exemplary embodiments are not limited thereto, and configuration may be made so as to limit the number of banknotes transacted in a transaction.

Moreover, in the exemplary embodiments described above, explanation has been given regarding a case in which the rotation angle of the reel 40 is computed by using the reel rotation-detecting sensor 43, this being an optical sensor, to detect the reel rotation detected portions 42, these being plate shaped members. The exemplary embodiments are not limited thereto, and the rotation angle of the reel 40 may be computed using various other methods.

Moreover, in the exemplary embodiments described above, explanation has been given regarding a case in which the rotation angle of the drum 34 is computed by using an encoder to detect the rotation amount of the motor that rotates the drum 34. The exemplary embodiments are not limited thereto, and the rotation angle of the drum 34 may be computed using various other methods.

Moreover, in the first exemplary embodiment described above, explanation has been given regarding a case in which the presence of the lever detected portion 54 is detected by detecting the lever detected portion 54, configured from a plate shaped member, using the lever detection sensor 56, this being an optical sensor. The exemplary embodiments are not limited thereto, and the presence of the lever detected portion 54 may be detected using various other methods, such as magnetic sensors. The same also applies to the second to the fifth exemplary embodiments.

Moreover, in the first exemplary embodiment described above, explanation has been given regarding a case in which the lever detected portion 54 moves away from the optical axis of the lever detection sensor 56 when the restriction lever 48 has pivoted in the lever approach direction Rlp to adopt the lever engaged state. The exemplary embodiment is not limited thereto, and configuration may be made such that the lever detected portion 54 blocks the optical axis of the lever detection sensor 56 when the restriction lever 48 has pivoted in the lever approach direction Rlp to adopt the lever engaged state.

Moreover, in Equation (1) described above, ϕA0 may be replaced with the drum outer diameter Dod. In such cases, since the value of the drum outer diameter Dod will be uniform regardless of the state of the tape, the reel-and-tape outer diameter Rtod may be computed consistently regardless of the state of the tape.

Moreover, in the first exemplary embodiment described above, explanation has been given regarding a case in which reverse-winding of the drum 34 is prevented by the reverse-winding prevention mechanism 58. The exemplary embodiment is not limited thereto, and a mechanism equivalent to the reverse-winding prevention mechanism 58 may be provided to the pulley 44 so as to stop rotation of the pulley 44 when the tape terminal end portion has been reached. The same also applies to the second to the sixth exemplary embodiments.

Moreover, the tape 38 of the exemplary embodiments may be formed from a transparent resin material, may be an opaque tape that is easily visible, or may be patterned.

Moreover, in the exemplary embodiments described above, explanation has been given regarding a case in which the present disclosure is applied to the ATM 1, 101, 201, 301, 401, and 501 that transacts banknotes. The present disclosure is not limited thereto, and may be applied to various devices that handle thin paper shaped media such as bond certificates, deed certificates, shopping vouchers, monetary coupons, or entry tickets. Moreover, the present disclosure may also be applied to a cash processing apparatus configured from a combination of plural devices for performing various processing relating to banknote and coin transactions, such as banknote pay-in/pay-out devices for paying in and paying out banknotes, or bundle sealing and payment machines that seal banknotes after every predetermined number of notes.

Moreover, in the exemplary embodiments described above, explanation has been given regarding a case in which the present disclosure is applied to an ATM that performs pay-in transactions and pay-out transactions. However, the present disclosure may also be applied to a device that only performs one out of pay-in transactions or pay-out transactions.

In the exemplary embodiments described above, explanation has been given regarding cases in which the temporary retention section 20, 120, 220, 320, 420, 520, 620, or 720 serving as a medium processing device is configured by the drum 34, 134, 234, 334, 434, or 534 serving as a drum, 38, 538, or 738 serving as a tape, the reel 40 or 740 serving as a reel, and the reverse-winding prevention mechanism 58, 158, 258, 358, 458, 558, or 658 serving as a rotation restriction mechanism. However, exemplary embodiments are not limited thereto, and a medium processing device may be configured by drums, reels, tapes, and rotation restriction mechanisms of various other configurations.

In the exemplary embodiments described above, explanation has been given regarding cases in which the ATM 1, 101, 201, 301, 401, or 501, serving as a medium transaction device, is configured by the customer interface section 3 serving as a customer interface section, the drum 34, 134, 234, 334, 434, or 534 serving as a drum, 38, 538, or 738 serving as a tape, the reel 40 or 740 serving as a reel, and the reverse-winding prevention mechanism 58, 158, 258, 358, 458, 558, or 658 serving as a rotation restriction mechanism. However, exemplary embodiments are not limited thereto, and a medium transaction device may be configured by customer interface sections, drums, tapes, reels, and rotation restriction mechanisms of various other configurations.

INDUSTRIAL APPLICABILITY

The present disclosure may be applied to various devices that temporarily retain a paper shaped medium such as inserted banknotes wrapped around a drum together with a tape.

The invention claimed is:

1. A medium processing device, comprising:

a drum having a circular cylinder shape and that rotates about a rotation shaft;

a tape that, together with a medium to be stored, is wrapped onto a circumferential face of the drum;

a reel onto which the tape is pre-wound, and from which the tape is pulled out accompanying rotation of the drum; and a rotation restriction mechanism, comprising a stopper section, and a restriction section that includes a roller that rotates while abutting the tape, and an abutted portion, the stopper section abutting the abutted portion so as to restrict rotation of the drum in an unwind direction, the abutted portion of the restriction section not contacting the tape while the drum is rotating, the restriction section being restricted from moving toward an inside of the drum by the roller abutting the tape, being obstructed from moving by the tape wrapped onto the drum circumferential face, and moving when the drum rotates in the unwind direction to unwind the tape such that the tape comes away from the drum circumferential face to expose a wrapping location of the tape onto the circumferential face of the drum.

2. The medium processing device of claim 1, further comprising:

a second tape that is wrapped onto the drum circumferential face together with the tape and the medium such that the medium is sandwiched between the tape and the second tape; and a second reel onto which the second tape is pre-wound, and from which the second tape is pulled out accompanying rotation of the drum, wherein the rotation restriction mechanism comprises the restriction section that is obstructed from moving by the tape and the second tape wrapped onto the drum circumferential face, and that moves when the drum rotates in the unwind direction such that the tape and the second tape come away from the drum circumferential face to expose a wrapping location of the tape onto the drum circumferential face, and the stopper section that abuts the restriction section so as to restrict rotation of the drum in the unwind direction.

3. A medium transaction device comprising:

a customer interface section that receives a transaction relating to a medium; and the medium processing device of claim 1.

4. The medium processing device of claim 1, wherein the rotation restriction mechanism restricts rotation of the drum by the restriction section provided so as not to rotate synchronized with the drum and abutting the stopper section rotating synchronized with the drum.

5. The medium processing device of claim 4, further comprising a biasing section that biases the restriction section toward inside of the drum, wherein the restriction section restricts rotation of the drum by moving toward the inside of the drum and abutting the stopper section when the tape comes away from the drum to expose the drum circumferential face.

6. The medium processing device of claim 5, wherein the stopper section is a depression that is recessed from the drum circumferential face toward the inside of the drum at a location where the tape is wrapped onto the drum, and that has a width in a direction along the rotation shaft shorter than a width of the tape in the direction along the rotation shaft.

7. The medium processing device of claim 6, wherein:

the depression is a groove that runs in a rotation direction of the drum and that is recessed from the drum circumferential face toward the inside of the drum; and the stopper section is a stopper face formed at the groove.

8. The medium processing device of claim 7, further comprising a detection sensor that detects that the restriction section has moved into the groove.

9. The medium processing device of claim 8, further comprising a controller that controls the drum so as to stop rotation of the drum based on a detection result from the detection sensor.

10. The medium processing device of claim 9, wherein the controller stops the drum prior to the restriction section abutting the stopper face.

11. The medium processing device of claim 7, further comprising a guide mechanism that faces the tape, that is provided on an opposite side of the medium to the tape, and that guides a surface of the medium as the medium is being fed out from the drum.

12. The medium processing device of claim 11, wherein:

a plurality of the tapes are disposed in the direction along the rotation shaft; and the guide mechanism is provided at a location facing at least one of the plurality of tapes, and the restriction section is provided at the guide mechanism.

13. A medium processing device, comprising:

a drum having a circular cylinder shape and that rotates about a rotation shaft;

a tape that, together with a medium to be stored, is wrapped onto a circumferential face of the drum;

a reel onto which the tape is pre-wound, and from which the tape is pulled out accompanying rotation of the drum;

a rotation restriction mechanism, comprising a restriction section that is obstructed from moving by the tape wrapped onto the drum circumferential face, and that moves when the drum rotates in an unwind direction to unwind the tape such that the tape comes away from the drum circumferential face to expose a wrapping location of the tape onto the drum circumferential face, and a stopper section that abuts the restriction section so as to restrict rotation of the drum in the unwind direction; and a controller that, based on a ratio between a rotation angle of the drum and a rotation angle of the reel after the drum has been rotated through a predetermined angle from a predetermined reference position, a preset thickness of the tape, and a lower limit value of an outer diameter of the reel including the wound-on tape, computes a number of revolutions of the reel until the outer diameter of the reel including the wound-on tape reaches the lower limit value.

14. A medium processing device, comprising:

a drum having a circular cylinder shape and that rotates about a rotation shaft;

a tape that, together with a medium to be stored, is wrapped onto a circumferential face of the drum;

a reel onto which the tape is pre-wound, and from which the tape is pulled out accompanying rotation of the drum;

a rotation restriction mechanism, comprising a restriction section that is obstructed from moving by the tape wrapped onto the drum circumferential face, and that moves when the drum rotates in an unwind direction to unwind the tape such that the tape comes away from the drum circumferential face to expose a wrapping location of the tape onto the drum circumferential face, and a stopper section that abuts the restriction section so as to restrict rotation of the drum in the unwind direction; and a controller that determines a change in length of the tape by comparing a ratio between a rotation angle of the drum and a rotation angle of the reel after the drum has been rotated through a predetermined angle computed in an initialization operation against the same ratio as computed during a transaction operation.

* * * * *